US009875745B2

(12) United States Patent
Peters

(10) Patent No.: US 9,875,745 B2
(45) Date of Patent: Jan. 23, 2018

(54) NORMALIZATION OF AMBIENT HIGHER ORDER AMBISONIC AUDIO DATA

(71) Applicant: QUALCOMM Incorporated, San Diego, CA (US)

(72) Inventor: Nils Günther Peters, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 65 days.

(21) Appl. No.: 14/876,583

(22) Filed: Oct. 6, 2015

(65) Prior Publication Data

US 2016/0099001 A1 Apr. 7, 2016

Related U.S. Application Data

(60) Provisional application No. 62/061,068, filed on Oct. 7, 2014.

(51) Int. Cl.
*G10L 19/00* (2013.01)
*H04R 5/00* (2006.01)
(Continued)

(52) U.S. Cl.
CPC ..... *G10L 19/008* (2013.01); *H04S 3/008* (2013.01); *H04S 2400/13* (2013.01); *H04S 2420/11* (2013.01)

(58) Field of Classification Search
CPC ... G10L 19/008; G10L 19/038; G10L 19/167; G10L 19/06; G10L 19/20;
(Continued)

(56) References Cited

U.S. PATENT DOCUMENTS

2010/0158098 A1 6/2010 McSchooler et al.
2012/0155653 A1* 6/2012 Jax ..... G10L 19/008 381/22
(Continued)

FOREIGN PATENT DOCUMENTS

EP 2450880 A1 5/2012
WO 2014194099 A1 12/2014

OTHER PUBLICATIONS

Boehm, et al., "Proposed changes to the bitstream of RM0-HOA for integration of Qualcomm CE", MPEG Meeting; Jan. 2014; San Jose; (Motion Picture Expert Group or ISO/IECJTC1/SC29/WG11), No. m32246, KP030060698, 30 pp.
(Continued)

*Primary Examiner* — Thang Tran
(74) *Attorney, Agent, or Firm* — Shumaker & Sieffert, P.A.

(57) ABSTRACT

In general, techniques are directed to performing normalization with respect to ambient higher order ambisonic audio data. A device configured to decode higher order ambisonic audio data may perform the techniques. The device may include a memory and one or more processors. The memory may be configured to store an audio channel that provides a normalized ambient higher order ambisonic coefficient representative of at least a portion of an ambient component of a soundfield. The one or more processors may be configured to perform inverse normalization with respect to the audio channel.

31 Claims, 16 Drawing Sheets

(51) Int. Cl.
*G10L 19/008* (2013.01)
*H04S 3/00* (2006.01)

(58) Field of Classification Search
CPC ..... G10L 2019/0005; H04S 2420/03; H04S 2420/11; H04S 7/30; H04S 7/40; H04S 3/008; H04S 2400/01; H04S 2400/13; H04S 2400/15; H04S 5/005; G06F 17/16; H04R 5/00; H04R 5/04
See application file for complete search history.

(56) References Cited

U.S. PATENT DOCUMENTS

| | | | | |
|---|---|---|---|---|
| 2012/0275509 | A1 | 11/2012 | Smith et al. | |
| 2013/0216070 | A1* | 8/2013 | Keiler | G10L 19/008 381/300 |
| 2015/0213803 | A1 | 7/2015 | Peters et al. | |
| 2015/0341736 | A1* | 11/2015 | Peters | H04S 7/30 381/17 |
| 2015/0373473 | A1* | 12/2015 | Boehm | H03G 5/005 381/303 |
| 2016/0064005 | A1 | 3/2016 | Peters et al. | |
| 2016/0125890 | A1* | 5/2016 | Jax | G10L 19/008 381/22 |
| 2016/0150341 | A1* | 5/2016 | Kordon | G10L 19/008 381/23 |

OTHER PUBLICATIONS

Krueger, et al., "Restriction of the Dynamic Range of HOA Coefficients in the HOA Input Format," Mpeg Meeting; Jul. 7, 2014-Nov. 7, 2014; Sapporo; (Motion Picture Expert Group or ISO/IEC JTC1/SC29/WG11) No. m34239, Jul. 2014, XP030062612, 8 pp.
Boehm, et al., "Technical Description of the Technicolor Submission for the phase 2 CfP for 3D Audio," Mpeg Meeting; Jul. 2014; Sapporo; (Motion Picture Expert Group or ISO/IEC JTC1/SC29/WG11) No. m34237, XP030062610, 7 pp.
"Call for Proposals for 3D Audio," ISO/IEC JTC1/SC29/WG11/N13411, Jan. 2013, 20 pp.
Herre, et al., "MPEG-H 3D Audio—The New Standard for Coding of Immersive Spatial Audio," IEEE Journal of Selected Topics in Signal Processing, vol. 9, No. 5, Aug. 2015, pp. 770-779.
Poletti, "Three-Dimensional Surround Sound Systems Based on Spherical Harmonics," J. Audio Eng. Soc., vol. 53, No. 11, Nov. 2005, pp. 1004-1025.
"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.
"Information technology—High efficiency coding and media delivery in heterogeneous environments—Part 3: 3D Audio," ISO/IEC JTC 1/SC 29N, Apr. 4, 2014, 337 pp.
"Information technology—High efficiency coding and media delivery in heterogeneous environments—Part 3: 3D Audio," ISO/IEC JTC 1/SC 29, Jul. 25, 2014, 311 pp.
Hellerud, et al., "Encoding Higher Order Ambisonics with AAC," AES 124th Convention, May 17-20, 2008, 8 pp.
Sen, et al., "RM1-1-HOA Working Draft Text ", MPEG Meeting; Jan. 2014; San Jose; (Motion Picture Expert Group or ISO/IEC JTC1/SC29/WG11), No. m31827, XP030060280, 83 pp.
International Search Report and Written Opinion from International Application No. PCT/US2015/054453, dated Jan. 4, 2016, 14 pp.
DavidS, "What's all this talk about mezzanine," root6 blog, posted on Apr. 4, 2012 on http://www.root6.com/blog/index.php/2012/04/whats-all-this-talk-about-mezzanine/, 1 pp.
"Proposed 14496-26, Audio Conformance," MPEG Meeting; Jul. 21-25, 2008; Hannover; (Motion Picture Expert Group or ISO/IEC JTC1/SC29/WG11), No. N10041, Jul. 26, 2008, XP030016535, 182 pp., ISSN: 0000-0039, Section 6.8.2.2.
Tektronix: "Monitoring Surround-Sound Audio," Internet Citation, Jul. 2005, 32 pp., XP007904948, Retrieved from the Internet: URL: http://www.tektronik.com/ [retrieved on Jun. 13, 2008] section "Monitoring Multi-Channel Audio Signals," on p. 4; Section "Audio Compression" on pp. 17-18; section "Dolby Digital (AC-3) Vs. Dolby E".
Response to Written Opinion dated Jan. 4, 2016, from International Application No. PCT/US2015/054453, filed on Jul. 21, 2016, 2 pp.
Second Written Opinion from International Application No. PCT/US2015/054453, dated Sep. 21, 2016, 6 pp.
Response to Second Written Opinion dated Sep. 21, 2016, from International Application No. PCT/US2015/054453, filed on Nov. 8, 2016, 12 pp.
International Preliminary Report on Patentability dated Jan. 16, 2017, from International Application No. PCT/US2015/054453, 15 pp.

* cited by examiner

NORMALIZATION OF AMBIENT HIGHER ORDER AMBISONIC AUDIO DATA

This application claims the benefit of U.S. Provisional Application No. 62/061,068, entitled "NORMALIZATION OF AMBIENT HIGHER ORDER AMBISONIC AUDIO DATA," filed Oct. 7, 2014, the entire content of which is incorporated herein by reference.

TECHNICAL FIELD

This disclosure relates to audio data and, more specifically, compression of audio data.

BACKGROUND

A higher order ambisonics (HOA) signal (often represented by a plurality of spherical harmonic coefficients (SHC) or other hierarchical elements) is a three-dimensional (3D) representation of a soundfield. The HOA or SHC representation may represent this soundfield in a manner that is independent of the local speaker geometry used to playback a multi-channel audio signal rendered from this SHC signal. The SHC signal may also facilitate backwards compatibility as the SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In general, techniques are described for performing normalization with respect to ambient higher order ambisonic audio data.

In one aspect, a method comprises performing normalization with respect to an audio channel that provides an ambient higher order ambisonic coefficient, the ambient higher order ambisonic audio coefficient representative of at least a portion of an ambient component of a soundfield.

In one aspect, a device comprises a memory configured to store an audio channel that provides an ambient higher order ambisonic coefficient representative of at least a portion of an ambient component of a soundfield, and one or more processors configured to perform normalization with respect to the audio channel.

In one aspect, a device comprises means for storing an audio channel that provides an ambient higher order ambisonic coefficient representative of at least a portion of an ambient component of a soundfield, and means for performing normalization with respect to the audio channel.

In one aspect, a non-transitory computer-readable storage medium has stored thereon instructions that, when executed, cause one or more processors to perform normalization with respect to an audio channel that provides an ambient higher order ambisonic coefficient, the ambient higher order ambisonic audio coefficient representative of at least a portion of an ambient component of a soundfield.

In one aspect, a method comprises performing inverse normalization with respect to an audio channel that provides a normalized ambient higher order ambisonic coefficient, the ambient higher order ambisonic audio coefficient representative of at least a portion of an ambient component of a soundfield.

In one aspect, a device comprises a memory configured to store an audio channel that provides a normalized ambient higher order ambisonic coefficient representative of at least a portion of an ambient component of a soundfield, and one or more processors configured to perform inverse normalization with respect to the audio channel.

In one aspect, a device comprises means for storing an audio channel that provides a normalized ambient higher order ambisonic coefficient representative of at least a portion of an ambient component of a soundfield, and means for performing inverse normalization with respect to the audio channel.

In one aspect, a non-transitory computer-readable storage medium has stored thereon instructions that, when executed, cause one or more processors to perform inverse normalization with respect to an audio channel that provides a normalized ambient higher order ambisonic coefficient, the ambient higher order ambisonic audio coefficient representative of at least a portion of an ambient component of a soundfield.

In one aspect, a method comprises performing normalization with respect to an audio channel that provides an ambient higher order ambisonic coefficient, the ambient higher order ambisonic audio coefficient representative of at least a portion of an ambient component of a soundfield and associated with a spherical basis function having an order greater than zero.

In one aspect, a device comprises a memory configured to store an audio channel that provides an ambient higher order ambisonic coefficient representative of at least a portion of an ambient component of a soundfield and associated with a spherical basis function having an order greater than zero, and one or more processors configured to perform normalization with respect to the audio channel.

In one aspect, a device comprises means for storing an audio channel that provides an ambient higher order ambisonic coefficient representative of at least a portion of an ambient component of a soundfield and associated with a spherical basis function having an order greater than zero, and means for performing normalization with respect to the audio channel.

In one aspect, a non-transitory computer-readable storage medium has stored thereon instructions that, when executed, cause one or more processors to perform normalization with respect to an audio channel that provides an ambient higher order ambisonic coefficient, the ambient higher order ambisonic audio coefficient representative of at least a portion of an ambient component of a soundfield and associated with a spherical basis function having an order greater than zero.

In one aspect, a method comprises performing inverse normalization with respect to an audio channel that provides a normalized ambient higher order ambisonic coefficient, the normalized ambient higher order ambisonic audio coefficient representative of at least a portion of an ambient component of a soundfield and associated with a spherical basis function having an order greater than zero.

In one aspect, a device comprises a memory configured to store an audio channel that provides a normalized ambient higher order ambisonic coefficient representative of at least a portion of an ambient component of a soundfield and associated with a spherical basis function having an order greater than zero, and one or more processors configured to perform inverse normalization with respect to the audio channel.

In one aspect, a device comprises means for storing an audio channel that provides a normalized ambient higher order ambisonic coefficient representative of at least a portion of an ambient component of a soundfield and associated with a spherical basis function having an order greater than zero, and means for performing inverse normalization with respect to the audio channel.

In one aspect, a non-transitory computer-readable storage medium has stored thereon instructions that, when executed, cause one or more processors to perform inverse normalization with respect to an audio channel that provides a normalized ambient higher order ambisonic coefficient, the ambient higher order ambisonic audio coefficient representative of at least a portion of an ambient component of a soundfield and associated with a spherical basis function having an order greater than zero.

The details of one or more aspects of the techniques are set forth in the accompanying drawings and the description below. Other features, objects, and advantages of these techniques will be apparent from the description and drawings, and from the claims.

DETAILED DESCRIPTION

Figure 1:
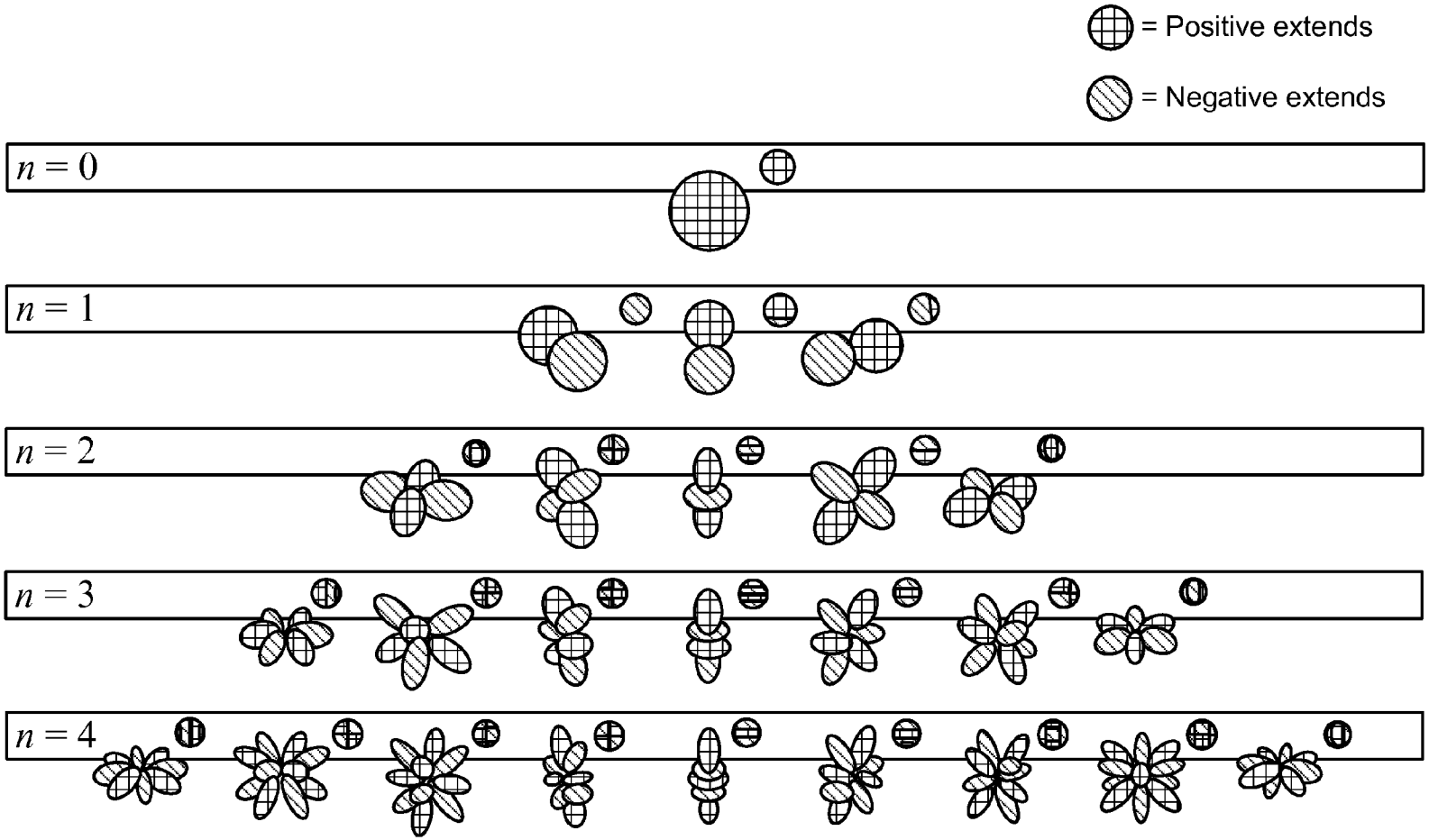
FIG. 1 is a diagram illustrating spherical harmonic basis functions of various orders and sub-orders.

The evolution of surround sound has made available many output formats for entertainment. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such an array includes 32 loudspeakers positioned on coordinates on the corners of a truncated icosahedron.

The input to a future MPEG encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher-order Ambisonics" or HOA, and "HOA coefficients"). A future MPEG encoder is described in more detail in a document entitled "Call for Proposals for 3D Audio," by the International Organization for Standardization/International Electrotechnical Commission (ISO)/(IEC) JTC1/SC29/WG11/N13411, released January 2013 in Geneva, Switzerland, and available at http://mpeg.chiariglione.org/sites/default/files/files/standards/parts/docs/w13411.zip.

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \varphi_r\}$ of the soundfield, at time t, can be represented uniquely by the SHC, $A_n^m(k)$. Here, $$k = \frac{\omega}{c},$$

c is the speed of sound (~343 m/s), $\{r_r, \theta_r, \varphi_r\}$ is a point of reference (or observation point), $j_n(\bullet)$ is the spherical Bessel function of order n, and $Y_n^m(\theta_r, \varphi_r)$ are the spherical harmonic basis functions of order n and suborder m. It can be recognized that the term in square brackets is a frequency-domain representation of the signal (i.e., $S(\omega, r_r, \theta_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^m(\theta_s,\varphi_s),$$

where i is $\sqrt{-1}$, $h_n^{(2)}(\bullet)$ is the spherical Hankel function (of the second kind) of order n, and $\{r_s, \theta_s, \varphi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \varphi_r\}$. The remaining figures are described below in the context of object-based and SHC-based audio coding.

Figure 2:
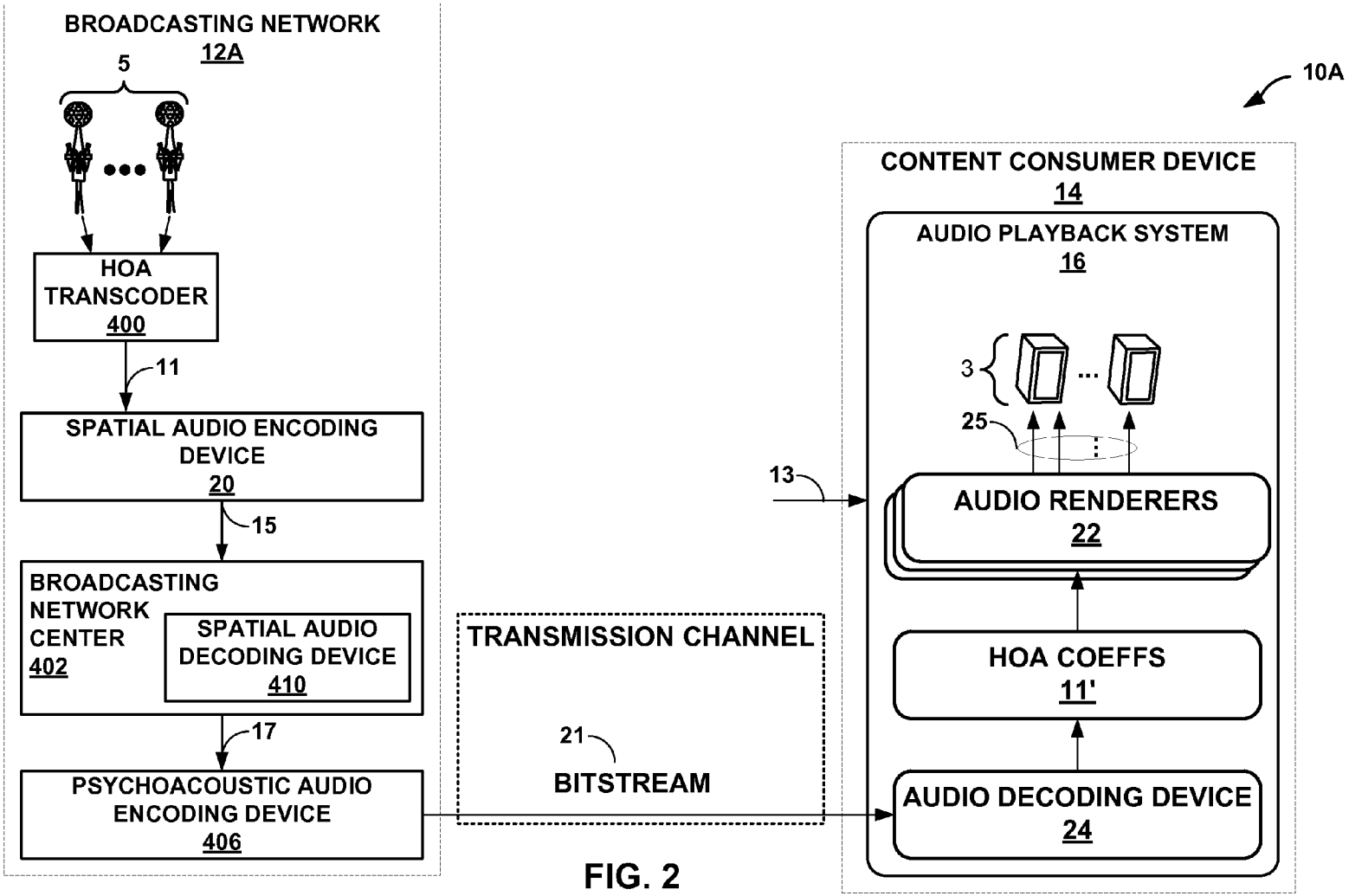
FIG. 2 is a diagram illustrating a system that may perform various aspects of the techniques described in this disclosure.

FIG. 2 is a diagram illustrating a system 10A that may perform various aspects of the techniques described in this disclosure. As shown in the example of FIG. 2, the system 10A includes a broadcasting network 12A and a content consumer device 14. While described in the context of the broadcasting network 12A and the content consumer device 14, the techniques may be implemented in any context in which SHCs (which may also be referred to as HOA coefficients) or any other hierarchical representation of a soundfield are encoded to form a bitstream representative of the audio data.

Moreover, the broadcasting network 12A may represent a system comprising one or more of any form of computing devices capable of implementing the techniques described in this disclosure, including a handset (or cellular phone), a tablet computer, a smart phone, a laptop computer, a desktop computer, or dedicated hardware to provide a few examples or. Likewise, the content consumer device 14 may represent any form of computing device capable of implementing the techniques described in this disclosure, including a handset (or cellular phone), a tablet computer, a smart phone, a television, a set-top box, a laptop computer, or a desktop computer to provide a few examples.

The broadcasting network 12A may represent any system that may generate multi-channel audio content and possibly video content for consumption by content consumer devices, such as by the content consumer device 14. The broadcasting network 12A may capture live audio data at events, such as sporting events, while also inserting various other types of additional audio data, such as commentary audio data, commercial audio data, intro or exit audio data and the like, into the live audio content.

The broadcasting network 12A includes microphones 5 that record or otherwise obtain live recordings in various formats (including directly as HOA coefficients) and audio objects. When the microphones 5 obtain live audio directly as HOA coefficients, the microphones 5 may include an HOA transcoder, such as an HOA transcoder 400 shown in the example of FIG. 2. In other words, although shown as separate from the microphones 5, a separate instance of the HOA transcoder 400 may be included within each of the microphones 5 so as to naturally transcode the captured feeds into the HOA coefficients 11. However, when not included within the microphones 5, the HOA transcoder 400 may transcode the live feeds output from the microphones 5 into the HOA coefficients 11. In this respect, the HOA transcoder 400 may represent a unit configured to transcode microphone feeds and/or audio objects into the HOA coefficients 11. The broadcasting network 12A therefore includes the HOA transcoder 400 as integrated with the microphones 5, as an HOA transcoder separate from the microphones 5 or some combination thereof.

The broadcasting network 12A may also include a spatial audio encoding device 20, a broadcasting network center 402 and a psychoacoustic audio encoding device 406. The spatial audio encoding device 20 may represent a device capable of performing the mezzanine compression techniques described in this disclosure with respect to the HOA coefficients 11 to obtain intermediately formatted audio data 15 (which may also be referred to as "mezzanine formatted audio data 15"). Although described in more detail below, the spatial audio encoding device 20 may be configured to perform this intermediate compression (which may also be referred to as "mezzanine compression") with respect to the HOA coefficients 11 by performing, at least in part, a decomposition (such as a linear decomposition described in more detail below) with respect to the HOA coefficients 11.

The spatial audio encoding device 20 may be configured to encode the HOA coefficients 11 using a decomposition involving application of a linear invertible transform (LIT). One example of the linear invertible transform is referred to as a "singular value decomposition" (or "SVD"), which may represent one form of a linear decomposition. In this example, the spatial audio encoding device 20 may apply SVD to the HOA coefficients 11 to determine a decomposed version of the HOA coefficients 11. The spatial audio encoding device 20 may then analyze the decomposed version of the HOA coefficients 11 to identify various parameters, which may facilitate reordering of the decomposed version of the HOA coefficients 11.

The spatial audio encoding device 20 may reorder the decomposed version of the HOA coefficients 11 based on the identified parameters, where such reordering, as described in further detail below, may improve coding efficiency given that the transformation may reorder the HOA coefficients across frames of the HOA coefficients (where a frame commonly includes M samples of the HOA coefficients 11 and M is, in some examples, set to 1024). After reordering the decomposed version of the HOA coefficients 11, the spatial audio encoding device 20 may select those of the decomposed version of the HOA coefficients 11 representative of foreground (or, in other words, distinct, predominant or salient) components of the soundfield. The spatial audio encoding device 20 may specify the decomposed version of the HOA coefficients 11 representative of the foreground components as an audio object and associated directional information.

The spatial audio encoding device 20 may also perform a soundfield analysis with respect to the HOA coefficients 11 in order, at least in part, to identify the HOA coefficients 11 representative of one or more background (or, in other words, ambient) components of the soundfield. The spatial audio encoding device 20 may perform energy compensation with respect to the background components given that, in some examples, the background components may only include a subset of any given sample of the HOA coefficients 11 (e.g., such as those corresponding to zero and first order spherical basis functions and not those corresponding to second or higher order spherical basis functions). When order-reduction is performed, in other words, the spatial audio encoding device 20 may augment (e.g., add/subtract energy to/from) the remaining background HOA coefficients of the HOA coefficients 11 to compensate for the change in overall energy that results from performing the order reduction.

The spatial audio encoding device 20 may perform a form of interpolation with respect to the foreground directional information and then perform an order reduction with respect to the interpolated foreground directional information to generate order reduced foreground directional information. The spatial audio encoding device 20 may further perform, in some examples, a quantization with respect to the order reduced foreground directional information, outputting coded foreground directional information. In some instances, this quantization may comprise a scalar/entropy quantization. The spatial audio encoding device 20 may then output the mezzanine formatted audio data 15 as the background components, the foreground audio objects, and the quantized directional information. The background components and the foreground audio objects may comprise pulse code modulated (PCM) transport channels in some examples.

The spatial audio encoding device 20 may then transmit or otherwise output the mezzanine formatted audio data 15 to the broadcasting network center 402. Although not shown in the example of FIG. 2, further processing of the mezzanine formatted audio data 15 may be performed to accommodate transmission from the spatial audio encoding device 20 to the broadcasting network center 402 (such as encryption, satellite compression schemes, fiber compression schemes, etc.).

Mezzanine formatted audio data 15 may represent audio data that conforms to a so-called mezzanine format, which is typically a lightly compressed (relative to end-user compression provided through application of psychoacoustic audio encoding to audio data, such as MPEG surround, MPEG-AAC, MPEG-USAC or other known forms of psychoacoustic encoding) version of the audio data. Given that broadcasters prefer dedicated equipment that provides low latency mixing, editing, and other audio and/or video functions, broadcasters are reluctant to upgrade the equipment given the cost of such dedicated equipment.

To accommodate the increasing bitrates of video and/or audio and provide interoperability with older or, in other words, legacy equipment that may not be adapted to work on high definition video content or 3D audio content, broadcasters have employed this intermediate compression scheme, which is generally referred to as "mezzanine compression," to reduce file sizes and thereby facilitate transfer times (such as over a network or between devices) and improved processing (especially for older legacy equipment). In other words, this mezzanine compression may provide a more lightweight version of the content which may be used to facilitate editing times, reduce latency and potentially improve the overall broadcasting process.

The broadcasting network center 402 may therefore represent a system responsible for editing and otherwise processing audio and/or video content using an intermediate compression scheme to improve the work flow in terms of latency. The broadcasting network center 402 may, in some examples, include a collection of mobile devices. In the context of processing audio data, the broadcasting network center 402 may, in some examples, insert intermediately formatted additional audio data into the live audio content represented by the mezzanine formatted audio data 15. This additional audio data may comprise commercial audio data representative of commercial audio content (including audio content for television commercials), television studio show audio data representative of television studio audio content, intro audio data representative of intro audio content, exit audio data representative of exit audio content, emergency audio data representative of emergency audio content (e.g., weather warnings, national emergencies, local emergencies, etc.) or any other type of audio data that may be inserted into mezzanine formatted audio data 15.

To allow for the mixing, other editing operations and monitoring of the mezzanine formatted audio data 15, the broadcast networking center 402 may include a spatial audio decoding device 410 to perform spatial audio decompression with respect to the mezzanine formatted audio data 15 to recover the HOA coefficients 11. The broadcasting network center 402 may then perform the mixing and other editing with respect to the HOA coefficients 11. Additional information concerning the mixing and other editing operations may be found in U.S. patent application Ser. No. 14/838,066, entitled "INTERMEDIATE COMPRESSION OF HIGHER ORDER AMBISONIC AUDIO DATA," filed Aug. 27, 2015. Although not shown in the example of FIG. 2, the broadcasting network center 402 may also include a spatial audio encoding device similar to spatial audio encoding device 20 configured to performing mezzanine compression with respect to the mixed or edited HOA coefficients and output updated mezzanine formatted audio data 17.

In some examples, the broadcasting network center 402 includes legacy audio equipment capable of processing up to 16 audio channels. In the context of 3D audio data that relies on HOA coefficients, such as the HOA coefficients 11, the HOA coefficients 11 may have more than 16 audio channels (e.g., a $4^{th}$ order representation of the 3D soundfield would require $(4+1)^2$ or 25 HOA coefficients per sample, which is equivalent to 25 audio channels). This limitation in legacy broadcasting equipment may slow adoption of 3D HOA-based audio formats, such as that set forth in the ISO/IEC DIS 23008-3 document, entitled "Information technology—High efficiency coding and media delivery in heterogeneous environments—Part 3: 3D audio," by ISO/IEC JTC 1/SC 29/WG 11, dated 2014 Jul. 25 (available at: http://mpeg.chiariglione.org/standards/mpeg-h/3d-audio/dis-mpeg-h-3d-audio, hereinafter referred to as "phase I of the 3D audio standard") or in the ISO/IEC DIS 23008-3:2015/PDAM 3 document, entitled "Information technology—High efficiency coding and media delivery in heterogeneous environments—Part 3: 3D audio, AMENDMENT 3: MPEG-H 3D Audio Phase 2," by ISO/IEC JTC 1/SC 29/WG 11, dated 2015 Jul. 25 (available at: http://mpeg.chiariglione.org/standards/mpeg-h/3d-audio/text-isoiec-23008-3201xpdam-3-mpeg-h-3d-audio-phase-2, and hereinafter referred to as "phase II of the 3D audio standard").

As such, various aspects of the techniques described in this disclosure may promote a form of mezzanine compression that allows for obtaining the mezzanine formatted audio data 15 from the HOA coefficients 11 in a manner that may overcome the channel-based limitations of legacy audio equipment. That is, the spatial audio encoding device 20 may be configured to perform various aspects of the techniques described in this disclosure to obtain the mezzanine audio data 15 having 16 or fewer audio channels (and possibly as few as 6 audio channels given that legacy audio equipment may, in some examples, allow for processing 5.1 audio content, where the '.1' represents the sixth audio channel).

In any event, the broadcasting network center 402 may output updated mezzanine formatted audio data 17. The updated mezzanine formatted audio data 17 may include the mezzanine formatted audio data 15 and any additional audio data inserted into the mezzanine formatted audio data 15 by the broadcasting network center 404. Prior to distribution, the broadcasting network 12A may further compress the updated mezzanine formatted audio data 17. As shown in the example of FIG. 2, the psychoacoustic audio encoding device 406 may perform psychoacoustic audio encoding (e.g., any one of the examples described above) with respect to the updated mezzanine formatted audio data 17 to generate a bitstream 21. The broadcasting network 12A may then transmit the bitstream 21 via a transmission channel to the content consumer device 14.

In some examples, the psychoacoustic audio encoding device 406 may represent multiple instances of a psychoacoustic audio coder, each of which is used to encode a different audio object or HOA channel of each of updated mezzanine formatted audio data 17. In some instances, this psychoacoustic audio encoding device 406 may represent one or more instances of an advanced audio coding (AAC) encoding unit. Often, the psychoacoustic audio encoding device 406 may invoke an instance of an AAC encoding unit for each of channel of the updated mezzanine formatted audio data 17. As an alternative to or in addition to AAC, the psychoacoustic audio encoding device 406 may represent one or more instances of a unified speech and audio coder (USAC).

More information regarding how the background spherical harmonic coefficients may be encoded using an AAC encoding unit can be found in a convention paper by Eric Hellerud, et al., entitled "Encoding Higher Order Ambisonics with AAC," presented at the $124^{th}$ Convention, 2008 May 17-20 and available at: http://ro.uow.edu.au/cgi/viewcontent.cgi?article=8025&context=engpapers. In some instances, the psychoacoustic audio encoding device 406 may audio encode various channels (e.g., background channels) of the updated mezzanine formatted audio data 17 using a lower target bitrate than that used to encode other channels (e.g., foreground channels) of the updated mezzanine formatted audio data 17.

While shown in FIG. 2 as being directly transmitted to the content consumer device 14, the broadcasting network 12A may output the bitstream 21 to an intermediate device positioned between the broadcasting network 12A and the content consumer device 14. The intermediate device may store the bitstream 21 for later delivery to the content consumer device 14, which may request this bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the broadcasting network 12A may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to those channels by which content stored to these mediums are transmitted (and may include retail stores and other store-based delivery mechanism). In any event, the techniques of this disclosure should not therefore be limited in this respect to the example of FIG. 2.

As further shown in the example of FIG. 2, the content consumer device 14 includes the audio playback system 16. The audio playback system 16 may represent any audio playback system capable of playing back multi-channel audio data. The audio playback system 16 may include a number of different audio renderers 22. The audio renderers 22 may each provide for a different form of rendering, where the different forms of rendering may include one or more of the various ways of performing vector-base amplitude panning (VBAP), and/or one or more of the various ways of performing soundfield synthesis.

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel. That is, the audio decoding device 24 may dequantize the foreground directional information specified in the bitstream 21, while also performing psychoacoustic decoding with respect to the foreground audio objects specified in the bitstream 21 and the encoded HOA coefficients representative of background components.

The audio decoding device 24 may further perform interpolation with respect to the decoded foreground directional information and then determine the HOA coefficients representative of the foreground components based on the decoded foreground audio objects and the interpolated foreground directional information. The audio decoding device 24 may then determine the HOA coefficients 11' based on the determined HOA coefficients representative of the foreground components and the decoded HOA coefficients representative of the background components.

The audio playback system 16 may, after decoding the bitstream 21 to obtain the HOA coefficients 11', render the HOA coefficients 11' to output loudspeaker feeds 25. The loudspeaker feeds 25 may drive one or more loudspeakers 3.

To select the appropriate renderer or, in some instances, generate an appropriate renderer, the audio playback system 16 may obtain loudspeaker information 13 indicative of a number of the loudspeakers 3 and/or a spatial geometry of the loudspeakers 3. In some instances, the audio playback system 16 may obtain the loudspeaker information 13 using a reference microphone and driving the loudspeakers 3 in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may select one of the audio renderers 22 based on the loudspeaker information 13. In some instances, the audio playback system 16 may, when none of the audio renderers 22 are within some threshold similarity measure (in terms of the loudspeaker geometry) to that specified in the loudspeaker information 13, generate the one of audio renderers 22 based on the loudspeaker information 13. The audio playback system 16 may, in some instances, generate the one of audio renderers 22 based on the loudspeaker information 13 without first attempting to select an existing one of the audio renderers 22.

Figure 3:
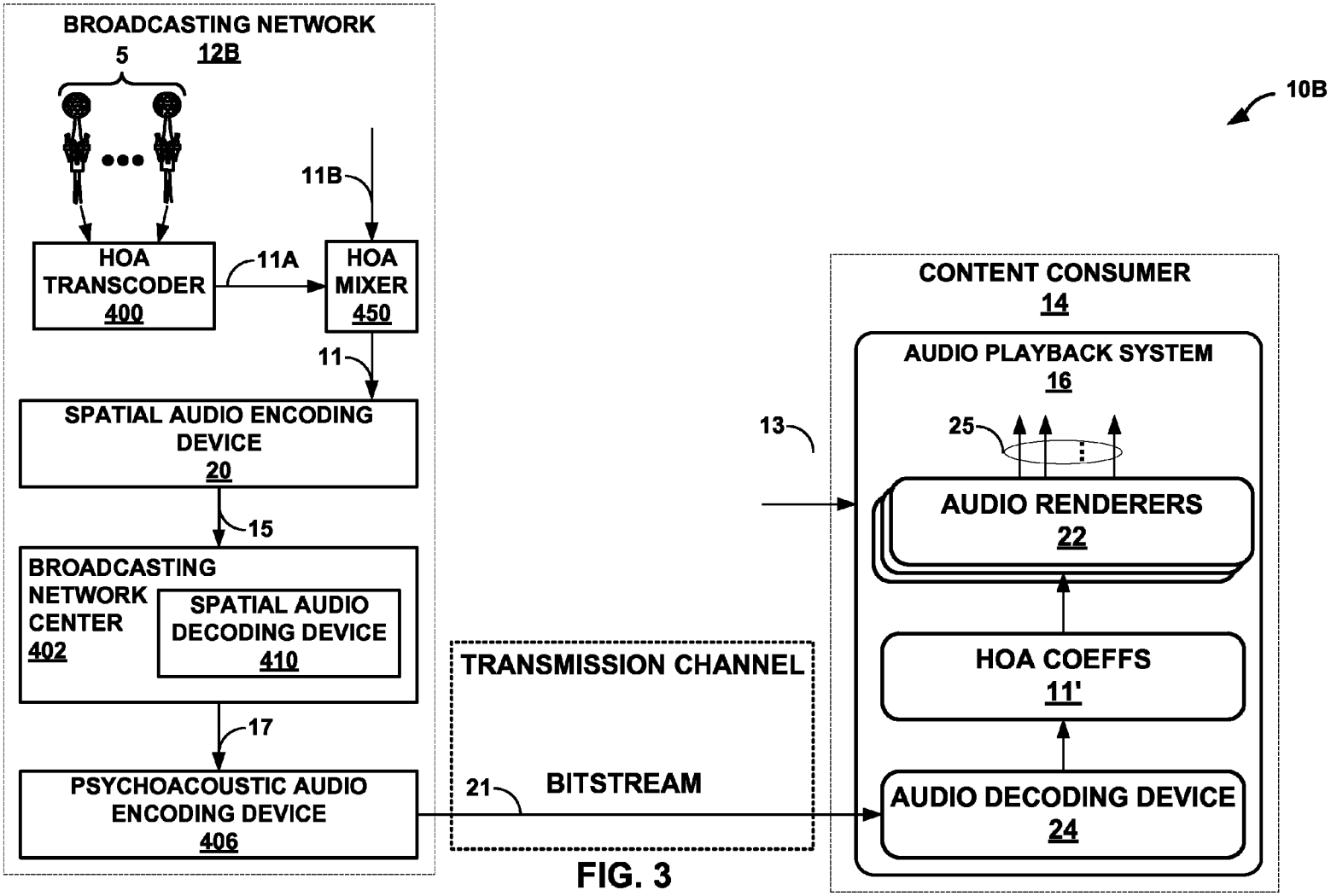
FIG. 3 is a block diagram illustrating a different example of the system shown in the example of FIG. 2.

FIG. 3 is a block diagram illustrating another example of a system 10B that may be configured to perform various aspects of the techniques described in this disclosure. The system 10B shown in FIG. 3 is similar to system 10A of FIG. 2 except that the broadcasting network 12B of the system 10B includes an additional HOA mixer 450. The HOA transcoder 400 may output the live feed HOA coefficients as HOA coefficients 11A to the HOA mixer 450. The HOA mixer represents a device or unit configured to mix HOA audio data. HOA mixer 450 may receive other HOA audio data 11B (which may be representative of any other type of audio data, including audio data captured with spot microphones or non-3D microphones and converted to the spherical harmonic domain, special effects specified in the HOA domain, etc.) and mix this HOA audio data 11B with HOA audio data 11A to obtain HOA coefficients 11.

Figure 4A:
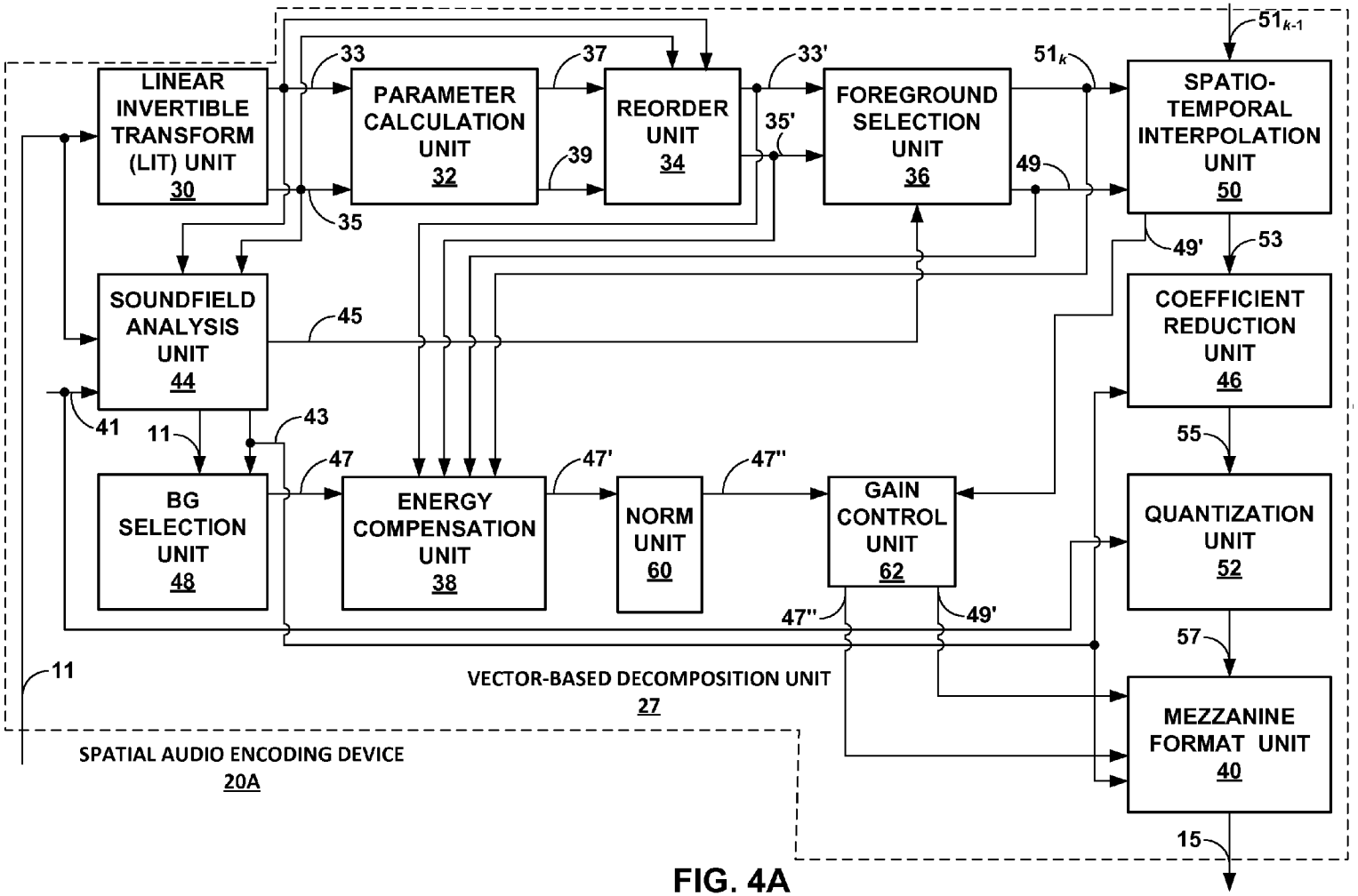
FIGS. 4A and 4B are block diagram each illustrating, in more detail, an example of the spatial audio encoding device shown in the examples of FIGS. 2 and 3 that may perform various aspects of the techniques described in this disclosure.
Figure 4B:
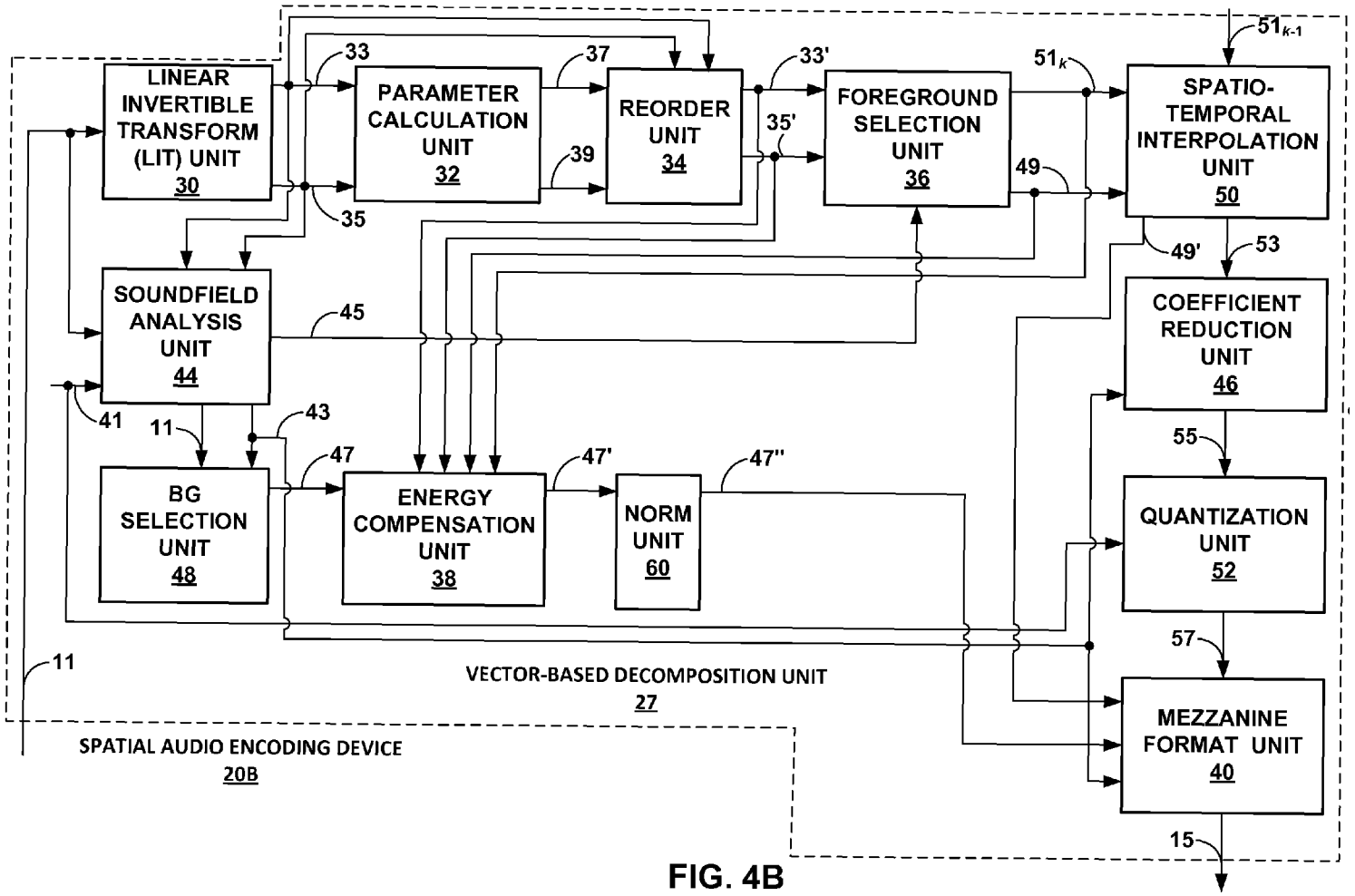

FIGS. 4A and 4B are block diagram each illustrating, in more detail, an example of the spatial audio encoding device 20 shown in the examples of FIGS. 2 and 3 that may perform various aspects of the techniques described in this disclosure. Referring first to FIG. 4A, the example of the spatial audio encoding device 20 is denoted as spatial audio encoding device 20A. The spatial audio encoding device 20A includes a vector-based decomposition unit 27.

Although described briefly below, more information regarding the vector-based decomposition units 27 and the various aspects of compressing HOA coefficients is available in International Patent Application Publication No. WO 2014/194099, entitled "INTERPOLATION FOR DECOMPOSED REPRESENTATIONS OF A SOUND FIELD," filed 29 May 2014. In addition, more details of various aspects of the compression of the HOA coefficients in accordance with the above referenced phases I and II of the 3D audio standard. A summary of the vector-based decomposition as performed in accordance with phase I of the 3D audio standard can further be found in a paper by Jurgen Herre, et al., entitled "MPEG-H 3D Audio—The New Standard for Coding of Immersive Spatial Audio," dated August 2015 and published in Vol. 9, No. 5 of the IEEE Journal of Selected Topics in Signal Processing.

As shown in the example of FIG. 4A, the vector-based decomposition unit 27 may include a linear invertible transform (LIT) unit 30, a parameter calculation unit 32, a reorder unit 34, a foreground selection unit 36, an energy compensation unit 38, a mezzanine format unit 40, a soundfield analysis unit 44, a coefficient reduction unit 46, a background (BG) selection unit 48, a spatio-temporal interpolation unit 50, a quantization unit 52, a normalization (norm) unit 60 and a gain control unit 62.

The linear invertible transform (LIT) unit 30 receives the HOA coefficients 11 in the form of HOA channels, each channel representative of a block or frame of a coefficient associated with a given order, sub-order of the spherical basis functions (which may be denoted as HOA[k], where k may denote the current frame or block of samples). The matrix of HOA coefficients 11 may have dimensions D: $M\times(N+1)^2$.

That is, the LIT unit 30 may represent a unit configured to perform a form of analysis referred to as singular value decomposition. While described with respect to SVD, the techniques described in this disclosure may be performed with respect to any similar linear transformation or linear decomposition (which may refer to a decomposition, as one example, that provides for sets of linearly uncorrelated output). Also, reference to "sets" in this disclosure is generally intended to refer to non-zero sets unless specifically stated to the contrary and is not intended to refer to the classical mathematical definition of sets that includes the so-called "empty set."

An alternative transformation may comprise a principal component analysis, which is often referred to as "PCA." PCA refers to a mathematical procedure that employs an orthogonal transformation to convert a set of observations of possibly correlated variables into a set of linearly uncorrelated variables referred to as principal components. Linearly uncorrelated variables represent variables that do not have a linear statistical relationship (or dependence) to one another. These principal components may be described as having a small degree of statistical correlation to one another.

The number of so-called principal components is less than or equal to the number of original variables. In some examples, the transformation is defined in such a way that the first principal component has the largest possible variance (or, in other words, accounts for as much of the variability in the data as possible), and each succeeding component in turn has the highest variance possible under the constraint that this successive component be orthogonal to (which may be restated as uncorrelated with) the preceding components. PCA may perform a form of order-reduction, which in terms of the HOA coefficients 11 may result in the compression of the HOA coefficients 11. Depending on the context, PCA may be referred to by a number of different names, such as discrete Karhunen-Loeve transform, the Hotelling transform, proper orthogonal decomposition (POD), and eigenvalue decomposition (EVD) to name a few examples.

Assuming for purposes of illustration only that the LIT unit 30 performs a singular value decomposition (which, again, may be referred to as "SVD") for purposes of example, the LIT unit 30 may transform the HOA coefficients 11 into two or more sets of transformed HOA coefficients. The "sets" of transformed HOA coefficients may include vectors of transformed HOA coefficients. In the example of FIG. 4A, the LIT unit 30 may perform the SVD with respect to the HOA coefficients 11 to generate a so-called V matrix, an S matrix, and a U matrix. SVD, in linear algebra, may represent a factorization of a y-by-z real or complex matrix X (where X may represent multi-channel audio data, such as the HOA coefficients 11) in the following form:

$$X=USV^*$$

U may represent a y-by-y real or complex unitary matrix, where the y columns of U are known as the left-singular vectors of the multi-channel audio data. S may represent a y-by-z rectangular diagonal matrix with non-negative real numbers on the diagonal, where the diagonal values of S are known as the singular values of the multi-channel audio data. V* (which may denote a conjugate transpose of V) may represent a z-by-z real or complex unitary matrix, where the z columns of V* are known as the right-singular vectors of the multi-channel audio data.

In some examples, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered to be the transpose of the V matrix. Below it is assumed, for ease of illustration purposes, that the HOA coefficients 11 comprise real-numbers with the result that the V matrix is output through SVD rather than the V* matrix. Moreover, while denoted as the V matrix in this disclosure, reference to the V matrix should be understood to refer to the transpose of the V matrix where appropriate. While assumed to be the V matrix, the techniques may be applied in a similar fashion to HOA coefficients 11 having complex coefficients, where the output of the SVD is the V* matrix. Accordingly, the techniques should not be limited in this respect to only provide for application of SVD to generate a V matrix, but may include application of SVD to HOA coefficients 11 having complex components to generate a V* matrix.

In this way, the LIT unit 30 may perform SVD with respect to the HOA coefficients 11 to output US[k] vectors 33 (which may represent a combined version of the S vectors and the U vectors) having dimensions D: $M\times(N+1)^2$, and V[k] vectors 35 having dimensions D: $(N+1)^2\times(N+1)^2$. Individual vector elements in the US[k] matrix may also be termed $X_{PS}(k)$ while individual vectors of the V[k] matrix may also be termed v(k).

An analysis of the U, S and V matrices may reveal that the matrices carry or represent spatial and temporal characteristics of the underlying soundfield represented above by X. Each of the N vectors in U (of length M samples) may represent normalized separated audio signals as a function of time (for the time period represented by M samples), that are orthogonal to each other and that have been decoupled from any spatial characteristics (which may also be referred to as directional information). The spatial characteristics, representing spatial shape and position (r, theta, phi) may instead be represented by individual $i^{th}$ vectors, $v^{(i)}(k)$, in the V matrix (each of length $(N+1)^2$).

The individual elements of each of $v^{(i)}(k)$ vectors may represent an HOA coefficient describing the spatial characteristics (e.g., shape including width) and position of the soundfield for an associated audio object. Both the vectors in the U matrix and the V matrix are normalized such that their root-mean-square energies are equal to unity. The energy of the audio signals in U are thus represented by the diagonal elements in S. Multiplying U and S to form US[k] (with individual vector elements $X_{PS}(k)$), thus represent the audio signal with energies. The ability of the SVD decomposition to decouple the audio time-signals (in U), their energies (in S) and their spatial characteristics (in V) may support various aspects of the techniques described in this disclosure. Further, the model of synthesizing the underlying HOA[k] coefficients, X, by a vector multiplication of US[k] and V[k] gives rise the term "vector-based decomposition," which is used throughout this document.

The parameter calculation unit 32 represents a unit configured to calculate various parameters, such as a correlation parameter (R), directional properties parameters (θ, φ, r), and an energy property (e). Each of the parameters for the current frame may be denoted as R[k], θ[k], φ[k], r[k] and e[k]. The parameter calculation unit 32 may perform an energy analysis and/or correlation (or so-called cross-correlation) with respect to the US[k] vectors 33 to identify the parameters. The parameter calculation unit 32 may also determine the parameters for the previous frame, where the previous frame parameters may be denoted R[k−1], θ[k−1], φ[k−1], r[k−1] and e[k−1], based on the previous frame of US[k−1] vector and V[k−1] vectors. The parameter calculation unit 32 may output the current parameters 37 and the previous parameters 39 to reorder unit 34.

The parameters calculated by the parameter calculation unit 32 may be used by the reorder unit 34 to re-order the audio objects to represent their natural evaluation or continuity over time. The reorder unit 34 may compare each of the parameters 37 from the first US[k] vectors 33 turn-wise against each of the parameters 39 for the second US[k−1] vectors 33. The reorder unit 34 may reorder (using, as one example, a Hungarian algorithm) the various vectors within the US[k] matrix 33 and the V[k] matrix 35 based on the current parameters 37 and the previous parameters 39 to output a reordered US[k] matrix 33' (which may be denoted mathematically as $\overline{US}[k]$) and a reordered V[k] matrix 35' (which may be denoted mathematically as $\overline{V}[k]$) to a foreground sound (or predominant sound—PS) selection unit 36 ("foreground selection unit 36") and an energy compensation unit 38.

The soundfield analysis unit 44 may represent a unit configured to perform a soundfield analysis with respect to the HOA coefficients 11 so as to potentially achieve a target bitrate 41. The soundfield analysis unit 44 may, based on the analysis and/or on a received target bitrate 41, determine the total number of psychoacoustic coder instantiations (which may be a function of the total number of ambient or background channels ($BG_{TOT}$) and the number of foreground channels or, in other words, predominant channels). The total number of psychoacoustic coder instantiations can be denoted as numHOATransportChannels.

The soundfield analysis unit 44 may also determine, again to potentially achieve the target bitrate 41, the total number of foreground channels (nFG) 45, the minimum order of the background (or, in other words, ambient) soundfield ($N_{BG}$ or, alternatively, MinAmbHOAorder), the corresponding number of actual channels representative of the minimum order of background soundfield (nBGa=(MinAmbHOAorder+1)$^2$), and indices (i) of additional BG HOA channels to send (which may collectively be denoted as background channel information 43 in the example of FIG. 4). The background channel information 42 may also be referred to as ambient channel information 43.

Each of the channels that remains from numHOATransportChannels—nBGa, may either be an "additional background/ambient channel", an "active vector-based predominant channel", an "active directional based predominant signal" or "completely inactive". In one aspect, the channel types may be indicated (as a "ChannelType") syntax element by two bits (e.g. 00: directional based signal; 01: vector-based predominant signal; 10: additional ambient signal; 11: inactive signal). The total number of background or ambient signals, nBGa, may be given by $(\text{MinAmbHOAorder}+1)^2$+ the number of times the index 10 (in the above example) appears as a channel type in the bitstream for that frame.

The soundfield analysis unit 44 may select the number of background (or, in other words, ambient) channels and the number of foreground (or, in other words, predominant) channels based on the target bitrate 41, selecting more background and/or foreground channels when the target bitrate 41 is relatively higher (e.g., when the target bitrate 41 equals or is greater than 512 Kbps). In one aspect, the numHOATransportChannels may be set to 8 while the MinAmbHOAorder may be set to 1 in the header section of the bitstream. In this scenario, at every frame, four channels may be dedicated to represent the background or ambient portion of the soundfield while the other 4 channels can, on a frame-by-frame basis, vary on the type of channel—e.g., either used as an additional background/ambient channel or a foreground/predominant channel. The foreground/predominant signals can be one of either vector-based or directional based signals, as described above.

In some instances, the total number of vector-based predominant signals for a frame, may be given by the number of times the ChannelType index is 01 in the bitstream of that frame. In the above aspect, for every additional background/ambient channel (e.g., corresponding to a ChannelType of 10), corresponding information of each of the possible HOA coefficients (beyond the first four) may be represented in that channel. The information, for fourth order HOA content, may be an index to indicate the HOA coefficients 5-25. The first four ambient HOA coefficients 1-4 may be sent all the time when minAmbHOAorder is set to 1; hence the audio encoding device may only need to indicate one of the additional ambient HOA coefficient having an index of 5-25. The information could thus be sent using a 5 bits syntax element (for $4^{th}$ order content), which may be denoted as "CodedAmbCoeffIdx." In any event, the soundfield analysis unit 44 outputs the background channel information 43 and the HOA coefficients 11 to the background (BG) selection unit 36, the background channel information 43 to coefficient reduction unit 46 and the mezzanine format unit 40, and the nFG 45 to a foreground selection unit 36.

The background selection unit 48 may represent a unit configured to determine background or ambient HOA coefficients 47 based on the background channel information (e.g., the background soundfield ($N_{BG}$) and the number (nBGa) and the indices (i) of additional BG HOA channels to send). For example, when $N_{BG}$ equals one, the background selection unit 48 may select the HOA coefficients 11 for each sample of the audio frame having an order equal to or less than one. The background selection unit 48 may, in this example, then select the HOA coefficients 11 having an index identified by one of the indices (i) as additional BG HOA coefficients, where the nBGa is provided to the mezzanine format unit 40 to be specified in the bitstream 21 so as to enable the audio decoding device, such as the audio decoding device 24 shown in the example of FIGS. 6 and 7, to parse the background HOA coefficients 47 from the bitstream 21. The background selection unit 48 may then output the ambient HOA coefficients 47 to the energy compensation unit 38. The ambient HOA coefficients 47 may have dimensions D: $M\times[(N_{BG}+1)^2+\text{nBGa}]$. The ambient HOA coefficients 47 may also be referred to as "ambient HOA coefficients 47," where each of the ambient HOA coefficients 47 corresponds to a separate ambient HOA channel 47 to be encoded by the psychoacoustic audio coder unit 40.

The foreground selection unit 36 may represent a unit configured to select the reordered US[k] matrix 33' and the reordered V[k] matrix 35' that represent foreground or distinct components of the soundfield based on nFG 45 (which may represent a one or more indices identifying the foreground vectors). The foreground selection unit 36 may output nFG signals 49 (which may be denoted as a reordered $US[k]_{1,\ldots,nFG}$ 49, $FG_{1,\ldots,nFG}[k]$ 49, or $X_{PS}^{(1\ldots nFG)}(k)$ 49) to the psychoacoustic audio coder unit 40, where the nFG signals 49 may have dimensions D: M×nFG and each represent mono-audio objects. The foreground selection unit 36 may also output the reordered V[k] matrix 35' (or $v^{(1\ldots nFG)}(k)$ 35') corresponding to foreground components of the soundfield to the spatio-temporal interpolation unit 50, where a subset of the reordered V[k] matrix 35' corresponding to the foreground components may be denoted as foreground V[k] matrix $\mathbf{51}_k$ (which may be mathematically denoted as $\overline{V}_{1,\ldots,nFG}[k]$) having dimensions D: $(N+1)^2\times nFG$.

The energy compensation unit 38 may represent a unit configured to perform energy compensation with respect to the ambient HOA coefficients 47 to compensate for energy loss due to removal of various ones of the HOA channels by the background selection unit 48. The energy compensation unit 38 may perform an energy analysis with respect to one or more of the reordered US[k] matrix 33', the reordered V[k] matrix 35', the nFG signals 49, the foreground V[k] vectors $\mathbf{51}_k$ and the ambient HOA coefficients 47 and then perform energy compensation based on the energy analysis to generate energy compensated ambient HOA coefficients 47'. The energy compensation unit 38 may output the energy compensated ambient HOA coefficients 47' to the normalization unit 60.

The normalization unit 60 may represent a unit configure to perform normalization with respect to an audio channel that includes at least one of the energy compensated ambient HOA coefficients 47' to obtain a normalized audio channel that includes a normalized ambient HOA coefficient 47'. Example normalization processes are full three-dimensional normalization (which is often abbreviated as N3D) and semi-three-dimensional normalization (which is often abbreviated as SN3D). The normalization unit 60 may perform the normalization to reduce artifacts introduced due to application of automatic gain control or other forms of gain control by gain control unit 62.

That is, as noted above, the soundfield analysis unit 44 may determine, again to potentially achieve the target bitrate 41, the minimum order of the background (or, in other words, ambient) soundfield ($N_{BG}$ or, alternatively, MinAmbHoaOrder), the corresponding number of actual channels representative of the minimum order of background soundfield ($\text{nBGa}=(\text{MinAmbHoaOrder}+1)^2$), and indices (i) of additional BG HOA channels to send (which again may collectively be denoted as background channel information 43 in the example of FIG. 4A). The soundfield analysis unit 44 may make these determinations dynamically, meaning that the number of additional ambient HOA channels may change on a frame-by-frame or other basis. Application of automatic gain control to a channel that is transitioning from describing a predominant (or, in other words, foreground) component of the soundfield to providing an additional HOA coefficient may result in the introduction of audio artifacts due to the large change in gain that may occur.

Figure 10:
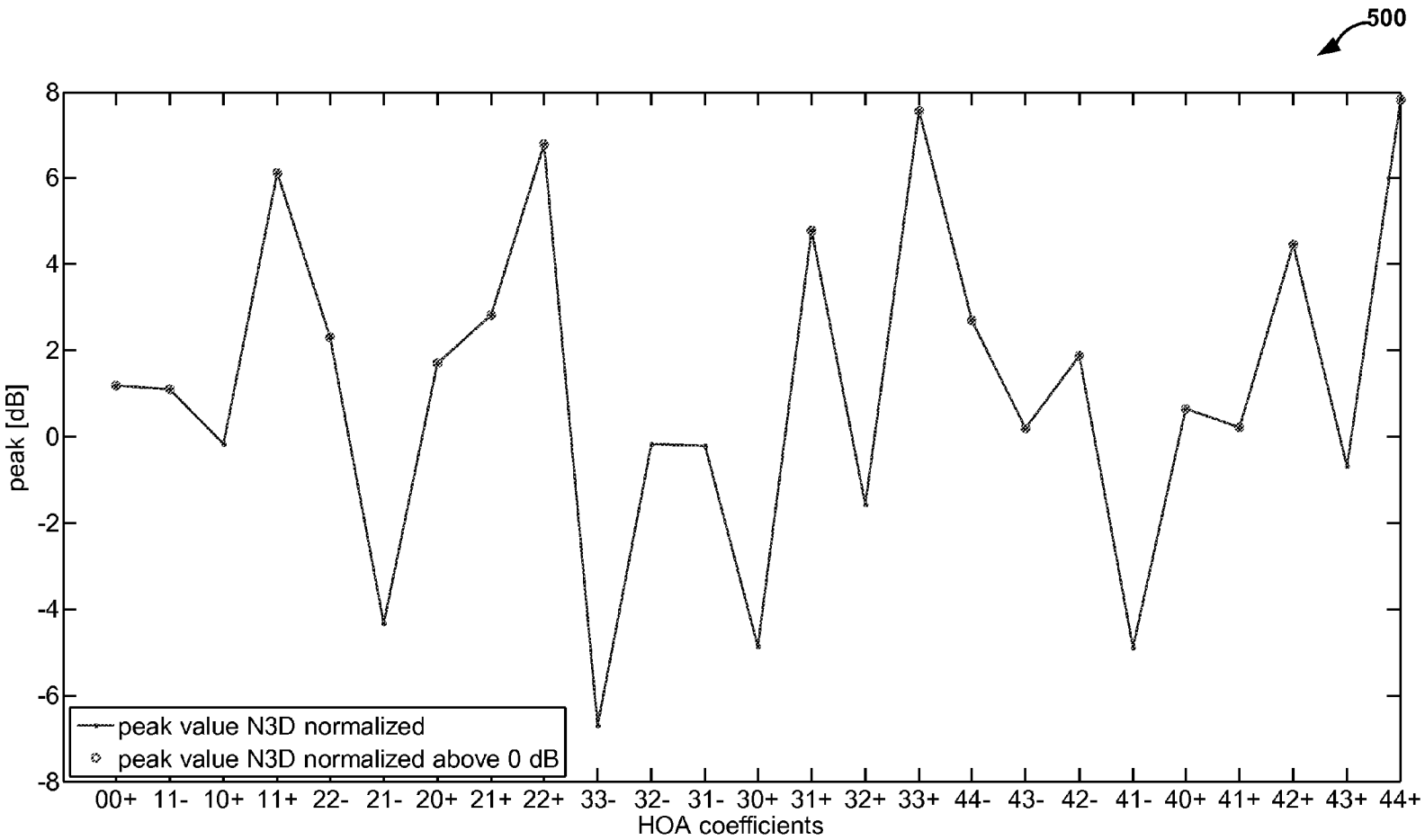
FIG. 10 is a diagram illustrating a graph showing peak normalization of a fourth order representation of a test item.

For example, consider a graph 500 shown in FIG. 10 showing peak (in decibels or dB) N3D normalization of an MPEG test item (which refers to an item used to test the encoding and decoding capabilities during MPEG standardization of 3D audio coding) for a fourth order (i.e., N=4) HOA representation of the test item. Along the y-axis of the graph 500 is the peak in dB, while the x-axis shows each coefficient by order (first number) and sub-order (second number) starting from the $0^{th}$ order, $0^{th}$ sub-order to the far left to the $4^{th}$ order, $+4^{th}$ sub-order (which is shown as 4+). Peak dB for the coefficient associated with the 1, 1+spherical basis function is nearly 6 dB, greatly exceeding the dynamic range of typical psychoacoustic encoders, such as that represented by the psychoacoustic audio coder unit 40. As a result, the vector-based synthesis unit 27 includes the gain control unit 62, which performs automatic gain control to reduce the peak dB to be between [−1, 1].

Figure 11:
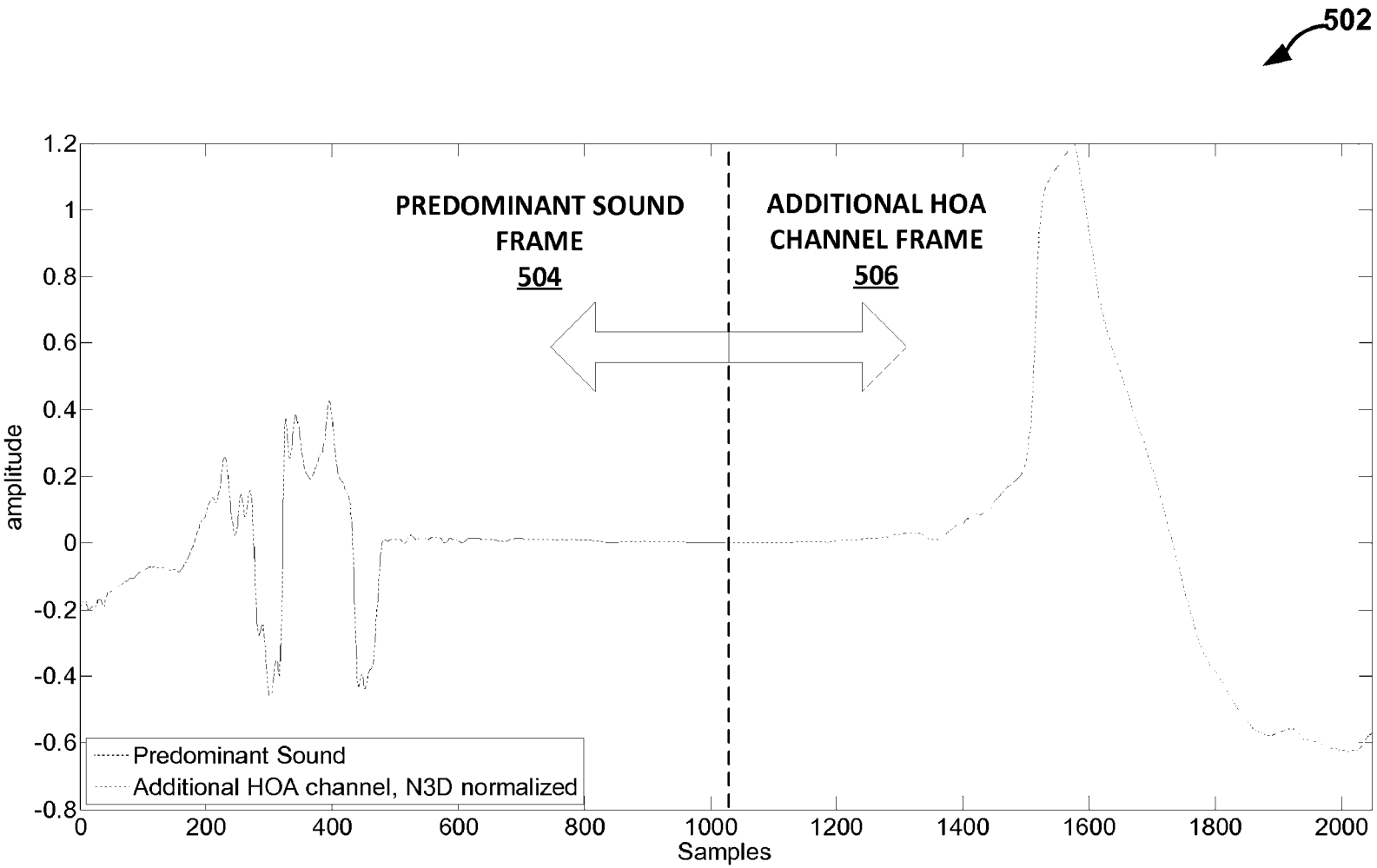
FIG. 11 is a diagram illustrating a graph showing a channel that switches from representing a predominant sound to providing an additional HOA channel.

Given that the audio encoding or compression process may switch between four different ChannelType options as noted above, a fade-in/fade-out operation may be performed when switching between these channel types. FIG. 11 is a diagram showing a graph 502 illustrating a channel that switches from representing a predominant (or, in other words, foreground) sound to providing an additional HOA channel (which typically provides a frame of coefficients associated with a single spherical basis function having an order greater than zero). The graph 502 shows how this switch may result in a nearly 0.8 difference in maximum amplitude between a predominant sound frame 504 (with a maximum amplitude of approximately 0.4 around sample 400) and an additional HOA channel frame 506 (with a maximum amplitude of approximately 1.2 around sample 1600). This large difference in amplitudes may result in audio artifacts when automatic gain control is applied by the gain control unit 62.

In other words, during the audio compression process (encoding), the spatial audio encoding device 20A has four ChannelType options to fill the transport channels dynamically: 0—direction-based signal; 1—vector-based signal; 2—additional ambient HOA coefficient; and 3—Empty. When changing from one type to another a fade-in/fade-out operation is performed to potentially avoid boundary artifacts. Further, the gain control unit 62 applies a gain control process on the transport channels where the signal gain is smoothly modified to achieve a value range [−1, 1] that is suitable of the perceptual encoders (e.g., represented by the psychoacoustic audio encoding device 406). The gain control unit 62 uses a one-frame look ahead when performing gain control to avoid severe gain changes between successive blocks. The gain control unit 62 may be reverted in the spatial audio decoding device 410 with gain control side information provided by the spatial audio encoding device 20A.

Figure 12:
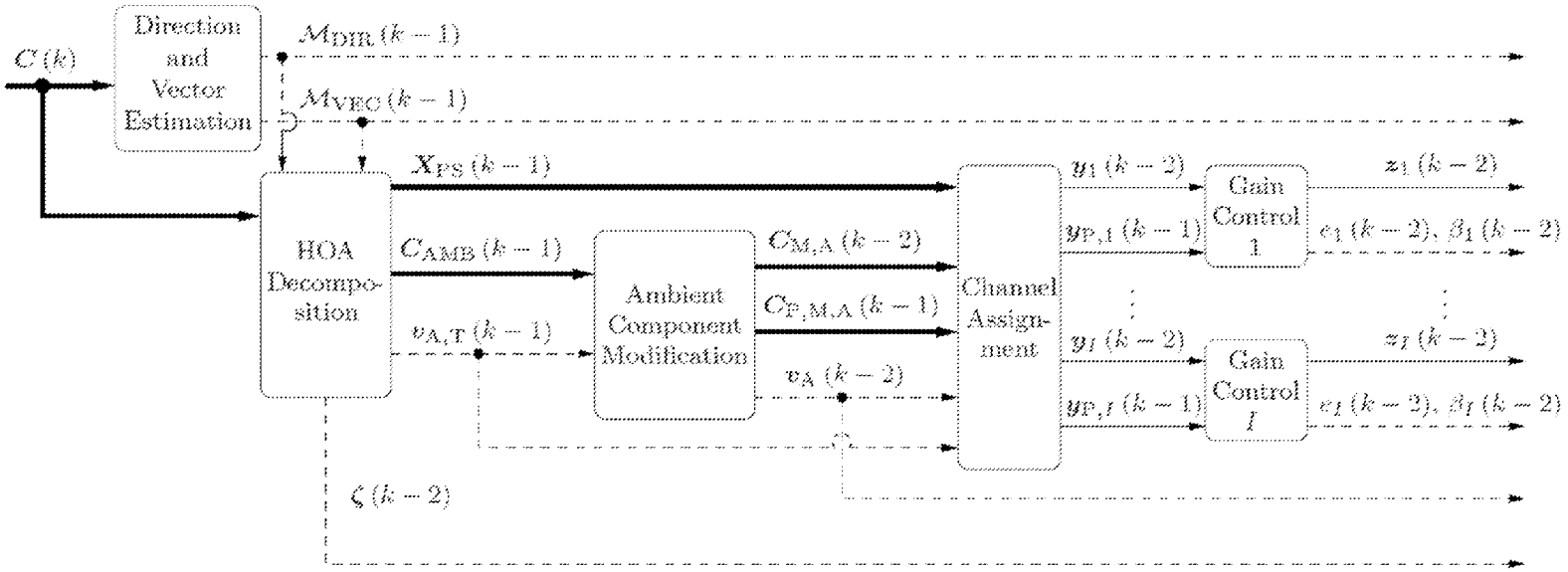
FIG. 12 is a diagram generally showing the flow of information as the information is processed by the spatial audio encoding device and the relative location of gain control as applied by the a standardized encoder.

FIG. 12 is a diagram generally showing the flow of information as the information is processed by the spatial audio encoding device 20A and the relative location of gain control as applied by the MPEG standardized encoder. The MPEG standardized encoder generally corresponds to the spatial audio encoding device 20 shown in the examples of FIGS. 2-4B and is described in more detail in the above referenced phase I and II of the 3D audio standard.

In any event, when the channel type switches from type 0 or 1, to type 2 (which refers to, in this example, an additional ambient HOA coefficient), a significant change in the amplitude values may occur as shown in graph 502 of FIG. 12. Consequently, the gain control unit 62 may perform gain control that has to significantly compensate the audio signal (e.g., in the predominant sound audio frame 504, the gain control unit 62 may amplify the signal, while in the additional ambient HOA channel frame 506, the gain control unit 62 may attenuate the signal). The result of such strong gain adaptation may cause undesired effects in the performance of the perceptual encoder (which again may be represented in the example of FIG. 2 as the psychoacoustic audio encoding device 406).

In accordance with the techniques described in this disclosure, normalization unit 60 may perform normalization with respect to an audio channel that provides an ambient higher order ambisonic coefficient, e.g., one of energy compensated ambient HOA coefficients 47'. As note above, the ambient higher order ambisonic audio coefficient 47' may be representative of at least a portion of an ambient component of a soundfield. As noted above, the normalization unit 60 may perform a three-dimensional normalization with respect to the audio channel that provides the ambient higher order ambisonic coefficient 47'. The normalization unit 60 may also perform a semi-three-dimensional normalization with respect to the audio channel that provides the ambient higher order ambisonic coefficient 47'. In some example, the ambient higher order ambisonic coefficient 47' is associated with a spherical basis function having an order greater than zero.

As further noted above, the ambient higher order ambisonic coefficient 47' may, in some examples, includes an ambient higher order ambisonic coefficient that is specified in addition to a plurality of ambient higher order ambisonic coefficients 47' specified in a plurality of different audio channels and that is used to augment the plurality of ambient higher order ambisonic coefficients 47' in representing the ambient component of the sound field. In this respect, the normalization unit 60 may apply a normalization factor to the ambient higher order ambisonic coefficient.

The normalization unit 60 may also determine a normalization factor as a function of at least one order of a spherical basis function to which the ambient higher order ambisonic coefficient is associated, and apply the normalization factor to the ambient higher order ambisonic coefficient. In these and other instances, the normalization unit 60 may determine a normalization factor in accordance with the following equation:

$$\text{Norm}=1/\sqrt{(1+2N)},$$

where Norm denotes the normalization factor and N denotes an order of a spherical basis function to which the ambient higher order ambisonic coefficient is associated. The normalization unit 60 may then apply the normalization factor, Norm, to the ambient higher order ambisonic coefficient.

As noted above, the ambient higher order ambisonic coefficient may be identified through a decomposition of a plurality higher order ambisonic coefficients representative of the soundfield. The ambient higher order ambisonic coefficient may be identified through application of a linear decomposition to a plurality higher order ambisonic coefficients representative of the soundfield.

The spatial audio encoding device 20A may further, as described above in this disclosure, transition the audio channel from providing a predominant audio object that describes a predominant component of the soundfield to providing the ambient higher order ambisonic coefficient. The spatial audio encoding device 20A may further, as described above in this disclosure, transition the audio channel from providing a predominant audio object to providing the ambient higher order ambisonic coefficient. In this instance, the normalization unit 60 may perform the normalization with respect to the audio channel only when the audio channel provides the ambient higher order ambisonic coefficient.

The spatial audio encoding device 20A may further, as described in this disclosure, transition the audio channel from providing a predominant audio object to providing the ambient higher order ambisonic coefficient. In this instance, the normalization unit 60 may performing the normalization with respect to the audio channel only when the audio channel provides the ambient higher order ambisonic coefficient. The spatial audio encoding device 20A may specify a syntax element in a bitstream indicating that the audio channel has transitioned from providing the predominant audio object to providing the ambient higher order ambisonic coefficient. The syntax element may be denoted as a "ChannelType" syntax element.

Figure 13:
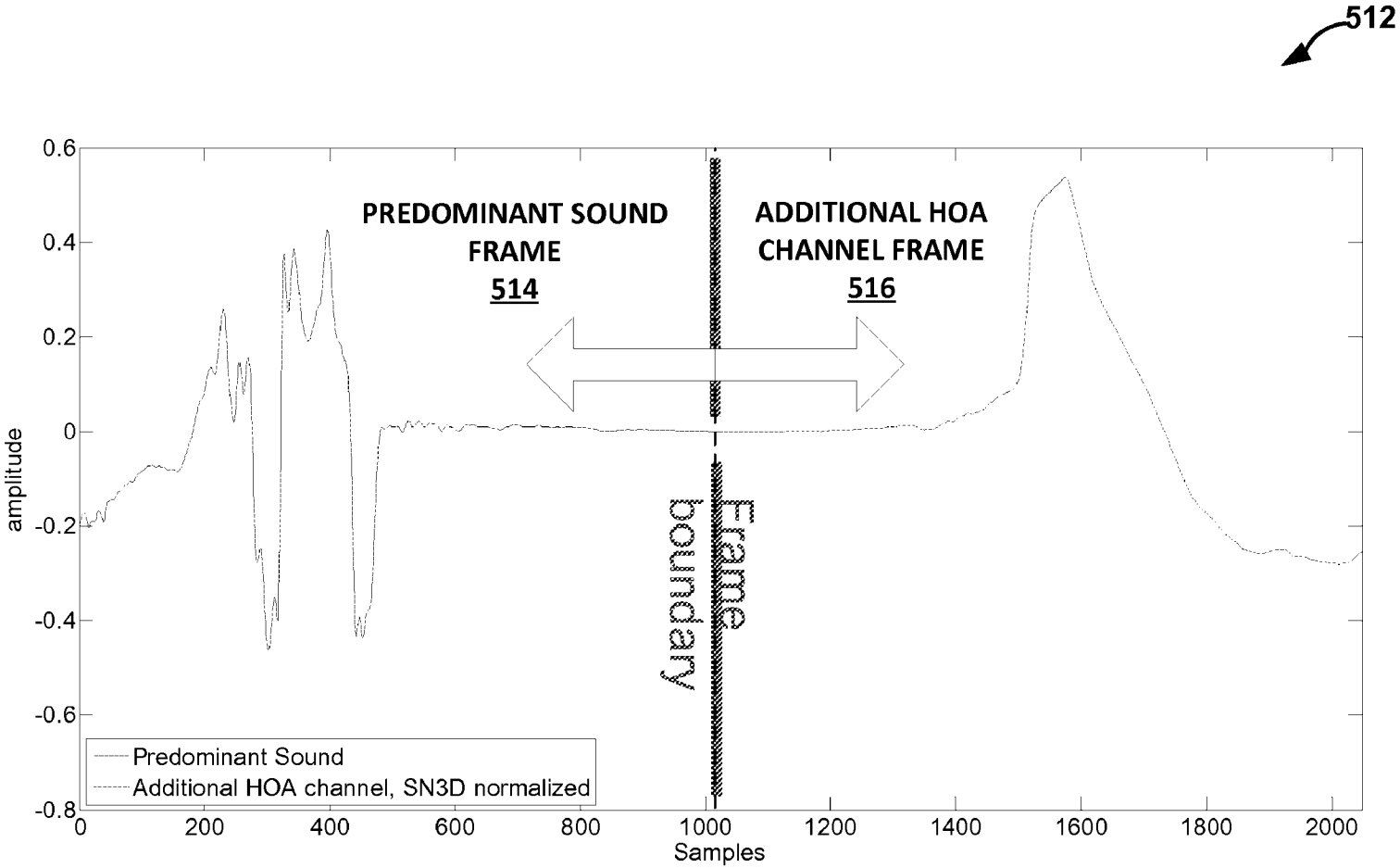
FIG. 13 is a diagram illustrating a graph that shows the result of applying the normalization factor to the additional HOA channel frame shown previously in graph as the additional HOA channel frame.

The techniques, in other words, may when an additional ambient HOA coefficient is selected by the spatial audio encoding device 20A, attenuate the amplitude of the additional ambient HOA coefficient prior to the gain control by the factor Norm, which as one example, may be equal to $1/\sqrt{(1+2N)}$. FIG. 13 is a diagram illustrating a graph 512 that shows the result of applying the normalization factor to the additional HOA channel frame shown previously in graph 502 as the additional HOA channel frame 506. The graph 512 shows a predominant sound frame 514, which is substantially similar to the predominant sound frame 504 of the graph 502. However, normalization of the additional HOA channel frame 506 in accordance with the techniques described in this disclosure with respect to the normalization unit 60 results in the additional HOA channel frame 516 having an attenuated maximum amplitude within the [1, −1] dynamic range. The normalization factor in this example may be $1/\sqrt{5}$, with N assumed to be 2 (meaning that the additional ambient HOA coefficient corresponds to a spherical basis function having an order of two, as 1+(2*2) equals 5. As shown in the graph 512, the signals may be better amplitude-aligned and a change in the gain control function may therefore be prevented. The normalization unit 60 may pass this audio channel that includes the normalized ambient HOA coefficient 47" to the gain control unit 62.

The gain control unit 62 may represent a unit configured to perform, as noted above, automatic gain control with respect to the audio channel. However, as noted above, due to the application of normalization to the normalized ambient HOA coefficient 47", the gain control unit 62 may determine that automatic gain control is not necessary given that the audio channel does not exceed the dynamic range of [1, −1] from frame to frame as shown in the example of FIG. 13. In these instances, the gain control unit 62 may not perform automatic gain control with respect to the audio channel, effectively passing through the normalized ambient HOA coefficient 47" to the psychoacoustic audio coder unit 40. Likewise, the gain control unit 62 may perform automatic gain control 62 with respect to the below described interpolated nFG signals 49' (which may be shown as the predominant sound frame 504 in FIG. 13 and the predominant sound frame 514 in FIG. 13). Again, however, the gain control unit 62 may not need to apply automatic gain control given that these frames 504 and 514 do not exceed the [1, −1] dynamic range, which again may result in the gain control unit 62 effectively passing through the interpolated nFG signals 49' to the psychoacoustic audio coder unit 40.

In this respect, the normalization unit 60 may perform the normalization with respect to the ambient higher order ambisonic coefficient, in some instances, prior to applying gain control to the audio channel. In these and other instances, the normalization unit 60 may perform the normalization with respect to the ambient higher order ambisonic coefficient so as to reduce application of gain control to the audio channel.

The spatio-temporal interpolation unit 50 may represent a unit configured to receive the foreground V[k] vectors $\mathbf{51}_k$ for the $k^{th}$ frame and the foreground V[k−1] vectors $\mathbf{51}_{k-1}$ for the previous frame (hence the k−1 notation) and perform spatio-temporal interpolation to generate interpolated foreground V[k] vectors. The spatio-temporal interpolation unit 50 may recombine the nFG signals 49 with the foreground V[k] vectors $\mathbf{51}_k$ to recover reordered foreground HOA coefficients. The spatio-temporal interpolation unit 50 may then divide the reordered foreground HOA coefficients by the interpolated V[k] vectors to generate interpolated nFG signals 49'.

The spatio-temporal interpolation unit 50 may also output the foreground V[k] vectors $\mathbf{51}_k$ that were used to generate the interpolated foreground V[k] vectors. An audio decoding device, such as the audio decoding device 24, may generate the interpolated foreground V[k] vectors based on the output foreground V[k] vectors $\mathbf{51}_k$ and thereby recover the foreground V[k] vectors $\mathbf{51}_k$. The foreground V[k] vectors $\mathbf{51}_k$ used to generate the interpolated foreground V[k] vectors are denoted as the remaining foreground V[k] vectors 53. In order to ensure that the same V[k] and V[k−1] are used at the encoder and decoder (to create the interpolated vectors V[k]) quantized/dequantized versions of the vectors may be used at the encoder and decoder. The spatio-temporal interpolation unit 50 may output the interpolated nFG signals 49' to the mezzanine format unit 40 and the interpolated foreground V[k] vectors $\mathbf{51}_k$ to the coefficient reduction unit 46.

The coefficient reduction unit 46 may represent a unit configured to perform coefficient reduction with respect to the remaining foreground V[k] vectors 53 based on the background channel information 43 to output reduced foreground V[k] vectors 55 to the quantization unit 52. The reduced foreground V[k] vectors 55 may have dimensions D: $[(N+1)^2-(N_{BG}+1)^2-BG_{TOT}]\times nFG$. The coefficient reduction unit 46 may, in this respect, represent a unit configured to reduce the number of coefficients in the remaining foreground V[k] vectors 53. In other words, coefficient reduction unit 46 may represent a unit configured to eliminate the coefficients in the foreground V[k] vectors (that form the remaining foreground V[k] vectors 53) having little to no directional information. In some examples, the coefficients of the distinct or, in other words, foreground V[k] vectors corresponding to a first and zero order basis functions (which may be denoted as $N_{BG}$) provide little directional information and therefore can be removed from the foreground V-vectors (through a process that may be referred to as "coefficient reduction"). In this example, greater flexibility may be provided to not only identify the coefficients that correspond $N_{BG}$ but to identify additional HOA channels (which may be denoted by the variable TotalOfAddAmbHOAChan) from the set of $[(N_{BG}+1)^2+1, (N+1)^2]$.

The quantization unit 52 may represent a unit configured to perform any form of quantization to compress the reduced foreground V[k] vectors 55 to generate coded foreground V[k] vectors 57, outputting the coded foreground V[k] vectors 57 to the mezzanine format unit 40. In operation, the quantization unit 52 may represent a unit configured to compress a spatial component of the soundfield, i.e., one or more of the reduced foreground V[k] vectors 55 in this example. The quantization unit 52 may perform any one of the following 12 quantization modes, as indicated by a quantization mode syntax element denoted "NbitsQ":

NbitsQ value Type of Quantization Mode
0-3: Reserved
4: Vector Quantization
5: Scalar Quantization without Huffman Coding
6: 6-bit Scalar Quantization with Huffman Coding
7: 7-bit Scalar Quantization with Huffman Coding
8: 8-bit Scalar Quantization with Huffman Coding
. . .
16: 16-bit Scalar Quantization with Huffman Coding The quantization unit 52 may also perform predicted versions of any of the foregoing types of quantization modes, where a difference is determined between an element of (or a weight when vector quantization is performed) of the V-vector of a previous frame and the element (or weight when vector quantization is performed) of the V-vector of a current frame is determined. The quantization unit 52 may then quantize the difference between the elements or weights of the current frame and previous frame rather than the value of the element of the V-vector of the current frame itself.

The quantization unit 52 may perform multiple forms of quantization with respect to each of the reduced foreground V[k] vectors 55 to obtain multiple coded versions of the reduced foreground V[k] vectors 55. The quantization unit 52 may select the one of the coded versions of the reduced foreground V[k] vectors 55 as the coded foreground V[k] vector 57. The quantization unit 52 may, in other words, select one of the non-predicted vector-quantized V-vector, predicted vector-quantized V-vector, the non-Huffman-coded scalar-quantized V-vector, and the Huffman-coded scalar-quantized V-vector to use as the output switched-quantized V-vector based on any combination of the criteria discussed in this disclosure.

In some examples, the quantization unit 52 may select a quantization mode from a set of quantization modes that includes a vector quantization mode and one or more scalar quantization modes, and quantize an input V-vector based on (or according to) the selected mode. The quantization unit 52 may then provide the selected one of the non-predicted vector-quantized V-vector (e.g., in terms of weight values or bits indicative thereof), predicted vector-quantized V-vector (e.g., in terms of error values or bits indicative thereof), the non-Huffman-coded scalar-quantized V-vector and the Huffman-coded scalar-quantized V-vector to the mezzanine format unit 40 as the coded foreground V[k] vectors 57. The quantization unit 52 may also provide the syntax elements indicative of the quantization mode (e.g., the NbitsQ syntax element) and any other syntax elements used to dequantize or otherwise reconstruct the V-vector.

The mezzanine format unit 40 included within the spatial audio encoding device 20A may represent a unit that formats data to conform to a known format (which may refer to a format known by a decoding device), thereby generating the mezzanine formatted audio data 15. The mezzanine format unit 40 may represent a multiplexer in some examples, which may receive the coded foreground V[k] vectors 57, normalized ambient HOA coefficients 47", the interpolated nFG signals 49' and the background channel information 43. The mezzanine format unit 40 may then generate the mezzanine formatted audio data 15 based on the coded foreground V[k] vectors 57, the normalized ambient HOA coefficients 47", the interpolated nFG signals 49' and the background channel information 43.

As noted above, the mezzanine formatted audio data 15 may include PCM transport channels and sideband (or, in other words, sidechannel) information. The sideband information may include the V[k] vectors 47 and other syntax elements described in more detail in the above referenced International Patent Application Publication No. WO 2014/194099, entitled "INTERPOLATION FOR DECOMPOSED REPRESENTATIONS OF A SOUND FIELD," filed 29 May 2014.

Although not shown in the example of FIG. 4A, the spatial audio encoding device 20A may also include a bitstream output unit that switches the bitstream output from the audio encoding device 20A (e.g., between the directional-based bitstream 21 and the vector-based bitstream 21) based on whether a current frame is to be encoded using the directional-based synthesis or the vector-based synthesis. The bitstream output unit may perform the switch based on the syntax element output by the content analysis unit 26 indicating whether a directional-based synthesis was performed (as a result of detecting that the HOA coefficients 11 were generated from a synthetic audio object) or a vector-based synthesis was performed (as a result of detecting that the HOA coefficients were recorded). The bitstream output unit may specify the correct header syntax to indicate the switch or current encoding used for the current frame along with the respective one of the bitstreams 21.

Moreover, as noted above, the soundfield analysis unit 44 may identify $BG_{TOT}$ ambient HOA coefficients 47, which may change on a frame-by-frame basis (although at times $BG_{TOT}$ may remain constant or the same across two or more adjacent (in time) frames). The change in $BG_{TOT}$ may result in changes to the coefficients expressed in the reduced foreground V[k] vectors 55. The change in $BG_{TOT}$ may result in background HOA coefficients (which may also be referred to as "ambient HOA coefficients") that change on a frame-by-frame basis (although, again, at times $BG_{TOT}$ may remain constant or the same across two or more adjacent (in time) frames). The changes often result in a change of energy for the aspects of the sound field represented by the addition or removal of the additional ambient HOA coefficients and the corresponding removal of coefficients from or addition of coefficients to the reduced foreground V[k] vectors 55.

As a result, the soundfield analysis unit 44 may further determine when the ambient HOA coefficients change from frame to frame and generate a flag or other syntax element indicative of the change to the ambient HOA coefficient in terms of being used to represent the ambient components of the sound field (where the change may also be referred to as a "transition" of the ambient HOA coefficient or as a "transition" of the ambient HOA coefficient). In particular, the coefficient reduction unit 46 may generate the flag (which may be denoted as an AmbCoeffTransition flag or an AmbCoeffIdxTransition flag), providing the flag to the mezzanine format unit 40 so that the flag may be included in the bitstream 21 (possibly as part of side channel information).

The coefficient reduction unit 46 may, in addition to specifying the ambient coefficient transition flag, also modify how the reduced foreground V[k] vectors 55 are generated. In one example, upon determining that one of the ambient HOA ambient coefficients is in transition during the current frame, the coefficient reduction unit 46 may specify, a vector coefficient (which may also be referred to as a "vector element" or "element") for each of the V-vectors of the reduced foreground V[k] vectors 55 that corresponds to the ambient HOA coefficient in transition. Again, the ambient HOA coefficient in transition may add or remove from the $BG_{TOT}$ total number of background coefficients. Therefore, the resulting change in the total number of background coefficients affects whether the ambient HOA coefficient is included or not included in the bitstream, and whether the corresponding element of the V-vectors are included for the V-vectors specified in the bitstream in the second and third configuration modes described above. More information regarding how the coefficient reduction unit 46 may specify the reduced foreground V[k] vectors 55 to overcome the changes in energy is provided in U.S. application Ser. No. 14/594,533, entitled "TRANSITIONING OF AMBIENT HIGHER ORDER AMBISONIC COEFFICIENTS," filed Jan. 12, 2015.

FIG. 4B is a block diagram illustrating another example of the audio encoding device 20 shown in the example of FIGS. 2 and 3. In other words, the spatial audio encoding device 20B shown in the example of FIG. 4B may represent one example of the spatial audio encoding device 20 shown in the example of FIGS. 2 and 3. The audio encoding device 20B of FIG. 4B may be substantially the same as that shown in the example of FIG. 4A, except that the audio encoding device 20B of FIG. 4B includes a modified version of the vector-based synthesis unit 27 denoted as vector-based synthesis unit 63. The vector-based synthesis unit 63 is similar to the vector-based synthesis unit 27 except for being modified to remove the gain control unit 62. In other words, the vector-based synthesis unit 63 does not include a gain control unit or otherwise perform automatic or other forms of gain control with respect to the normalized ambient HOA coefficients 47" or the interpolated nFG signals 49'.

Removal of this gain control unit 62 may result in more efficient (in terms of delay) audio encoding that may accommodate certain contexts, such as broadcast contexts. That is, gain control unit 62 may introduce delay as one or more frame lookahead mechanism is employed so as to determine whether to attenuate or otherwise amplify a signal is typically requires across frame boundaries. In broadcasting and other time sensitive encoding contexts, this delay may prevent adoption or further consideration of these coding techniques, especially for so-called "live" broadcasts that are common in news, sports and other programming. Removal of this gain control unit 62 may reduce gain and avoid one or two frame delays (where each reducing of frame delay may remove approximately 20 milliseconds (ms) of delay) and better accommodate broadcasting contexts that may adopt the audio coding techniques set forth in this disclosure for use as a mezzanine compression format.

In other words, the mezzanine format is transmitted as PCM uncompressed audio channels, which may allow for a maximum amplitude of 0 decibel (dB) full scale range (FSR) (+/−1.0 amplitude). To prevent clipping, the maximum amplitude limit may not exceed 0 dB FSR (+/−1.0 amplitude). Because the input HOA audio signal have been N3D normalized in some examples, the maximum amplitude limit may likely exceed 0 dB FSR when the ambient HOA coefficients of higher orders are transmitted.

To reduce or potentially avoid exceeding the 0 dB FSR, the audio encoding device 20 may apply automatic gain control before transmitting the signals. The audio decoding device 24 may then apply an inverse automatic gain control to recover the HOA audio signals. However, application of automatic gain control may result in additional sideband information to specify the gain control data that the audio decoding device 24 may use to perform the inverse automatic gain control. Also, application of automatic gain control may result in the delay noted above, which may not be suitable for some contexts (such as the broadcasting context).

Rather than apply N3D normalization and perform automatic gain control, the audio encoding device 20 may apply the SN3D normalization to the HOA audio signals and, in some examples, not perform the automatic gain control. By performing the SN3D normalization and not performing the automatic gain control, the audio encoding device 20 may not specify sideband information for the automatic gain control in the bitstream 21. Moreover, By performing the SN3D normalization and not performing the automatic gain control, the audio encoding device 20 may avoid any delay due to a lookahead required by the automatic gain control process, which may accommodate the broadcasting and other contexts.

Figure 5A:
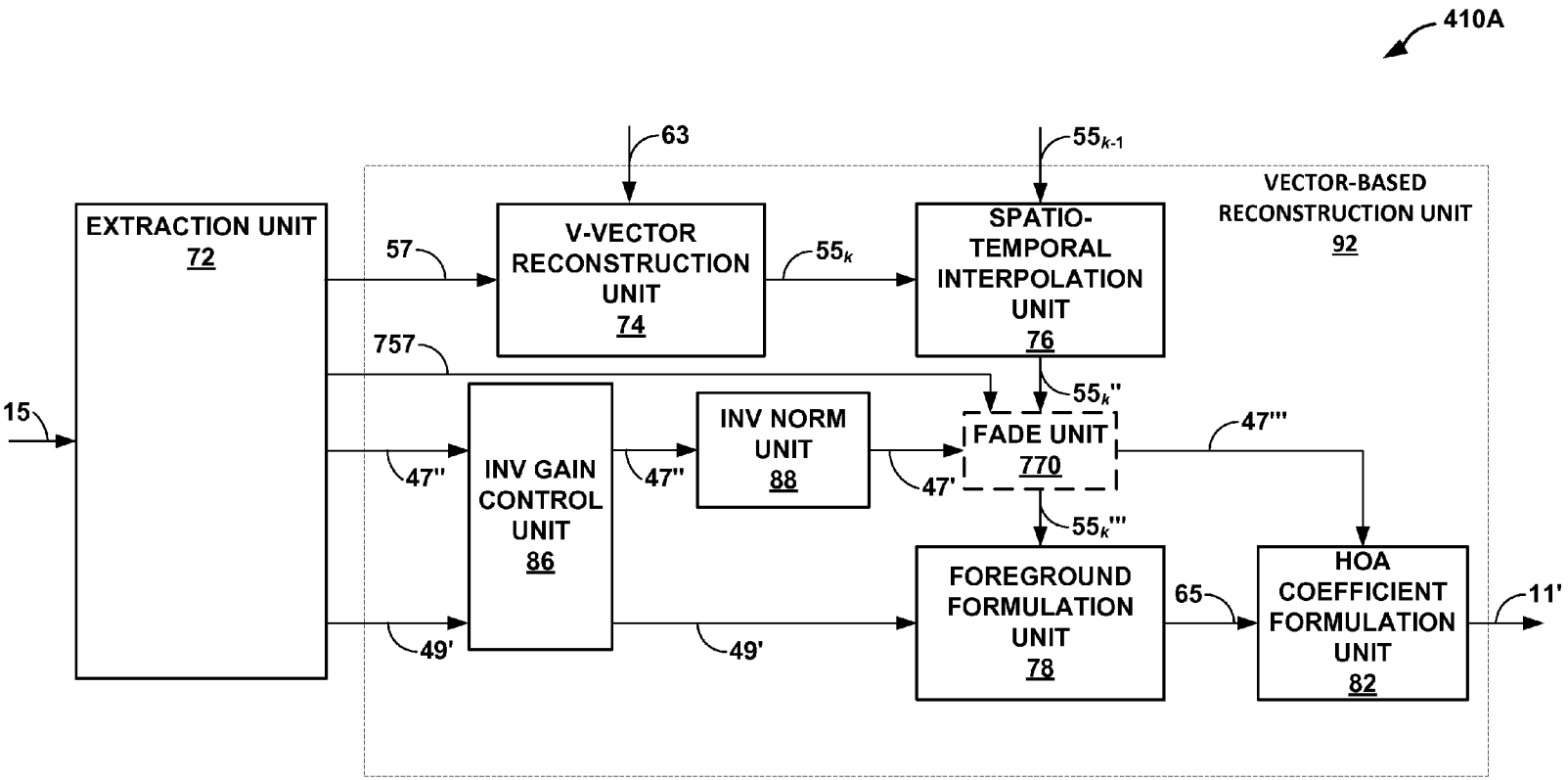
FIGS. 5A and 5B are block diagrams illustrating the spatial audio decoding device 410 of FIGS. 2 and 3 in more detail.
Figure 5B:
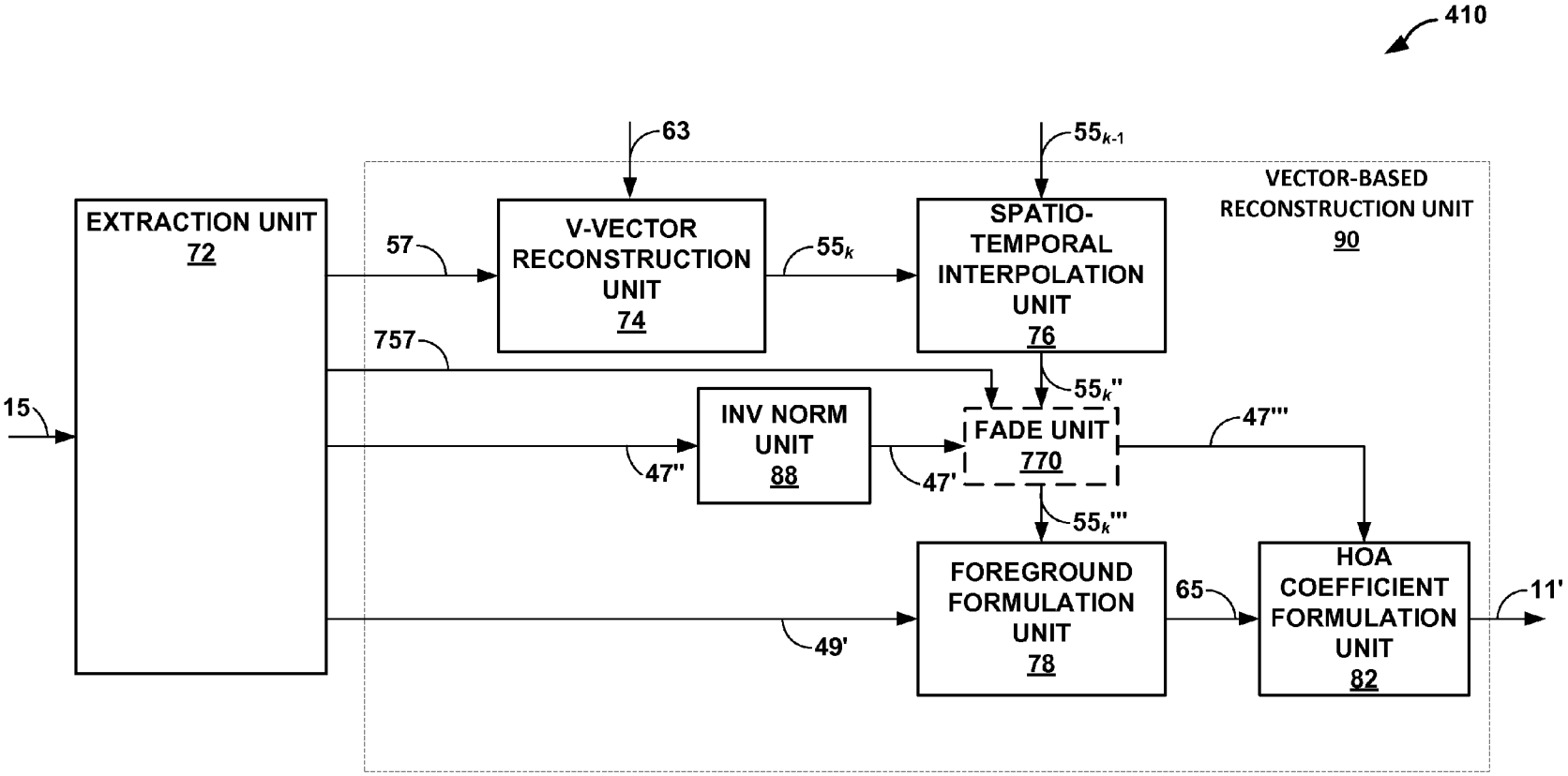

FIGS. 5A and 5B are block diagrams illustrating the spatial audio decoding device 410 of FIGS. 2 and 3 in more detail. Referring first to the example of FIG. 5A, the example of the spatial audio decoding device 410 shown in FIGS. 2 and 3 is shown as spatial audio decoding device 410A. The spatial audio decoding device 410A may include an extraction unit 72 and a vector-based reconstruction unit 92. Although described below, more information regarding the spatial audio decoding device 410A and the various aspects of decompressing or otherwise decoding HOA coefficients is available in International Patent Application Publication No. WO 2014/194099, entitled "INTERPOLATION FOR DECOMPOSED REPRESENTATIONS OF A SOUND FIELD," filed 29 May 2014. In addition, more details of various aspects of the decompression of the HOA coefficients in accordance with the above referenced phases I and II of the MPEG-H 3D audio coding standard.

The extraction unit 72 may represent a unit configured to receive the bitstream 15 and extract a vector-based encoded version of the HOA coefficients 11. The extraction unit 72 may extract the coded foreground V[k] vectors 57, the normalized ambient HOA coefficients 47" and the corresponding interpolated audio objects 49' (which may also be referred to as the interpolated nFG signals 49'). The audio objects 49' each correspond to one of the vectors 57. The extraction unit 72 may pass the coded foreground V[k] vectors 57 to the V-vector reconstruction unit 74, the normalized ambient HOA coefficients 47' to the inverse gain control unit 86, and the interpolated nFG signals 49' to the foreground formulization unit 78.

The inverse gain control unit 86 may represent a unit configured to perform an inverse gain control with respect to each of the normalized ambient HOA coefficients 47' and the interpolated nFG signals 49', where this inverse gain control is reciprocal to the gain control performed by the gain control unit 62. However, due to normalized nature (in terms of a reduced amplitude within the dynamic range of [1, −1]) of the normalized ambient HOA coefficients 47" and the general nature (in terms of normal amplitude within the dynamic range of [1, −1]) of the interpolated nFG signals 49', the inverse gain control unit 86 may effectively pass the normalized ambient HOA coefficients 47" to the inverse normalization unit 88 ("inv norm unit 88") and the interpolated nFG signals 49' to the foreground formulation unit 78 without applying any automatic or other forms of inverse gain control to the normalized ambient HOA coefficients 47" or the interpolated nFG signals 49'.

Although suggested above as potentially never applying inverse gain control, in various circumstances the inverse gain control unit 86 may apply gain control to either of the normalized ambient HOA coefficients 47" or the interpolated nFG signals 49' or both of the normalized ambient HOA coefficients 47" and the interpolated nFG signals 49'. The techniques may in these instances reduce the application of inverse gain control, which may reduce overhead in terms of side information sent to enable application of the inverse gain control and thereby promote more efficient coding of the HOA coefficients 11.

The inverse normalization unit 88 may represent a unit configured to perform an inverse normalization with respect to the normalized ambient HOA coefficients 47" that is generally reciprocal to the normalization applied by the normalization unit 60 shown in the examples of FIGS. 4A and 4B. The inverse normalization unit 88 may apply or otherwise perform with inverse normalization with respect to an audio channel that includes the normalized ambient HOA coefficients 47" to output energy compensated ambient HOA coefficients 47' to the fade unit 770.

The V-vector reconstruction unit 74 may represent a unit configured to reconstruct the V-vectors from the encoded foreground V[k] vectors 57. The V-vector reconstruction unit 74 may operate in a manner reciprocal to that of the quantization unit 52 to obtain the reduced foreground V[k] vectors $\mathbf{55}_k$. The V-vector reconstruction unit 74 may pass the foreground V[k] vectors 55 to the spatio-temporal interpolation unit 76.

The spatio-temporal interpolation unit 76 may operate in a manner similar to that described above with respect to the spatio-temporal interpolation unit 50. The spatio-temporal interpolation unit 76 may receive the reduced foreground V[k] vectors $\mathbf{55}_k$ and perform the spatio-temporal interpolation with respect to the reduced foreground V[k] vectors $\mathbf{55}_k$ and the reduced foreground V[k−1] vectors $\mathbf{55}_{k-1}$ to generate interpolated foreground V[k] vectors $\mathbf{55}_k$". The spatio-temporal interpolation unit 76 may forward the interpolated foreground V[k] vectors $\mathbf{55}_k$" to the fade unit 770.

The extraction unit 72 may also output a signal 757 indicative of when one of the ambient HOA coefficients is in transition to fade unit 770, which may then determine which of the $SHC_{BG}$ 47' (where the $SHC_{BG}$ 47' may also be denoted as "ambient HOA channels 47" or "energy compensated ambient HOA coefficients 47') and the elements of the interpolated foreground V[k] vectors $\mathbf{55}_k$" are to be either faded-in or faded-out. The fade unit 770 may output adjusted ambient HOA coefficients 47'" to the HOA coefficient formulation unit 82 and adjusted foreground V[k] vectors $\mathbf{55}_k$'" to the foreground formulation unit 78. In this respect, the fade unit 770 represents a unit configured to perform a fade operation with respect to various aspects of the HOA coefficients or derivatives thereof, e.g., in the form of the energy compensated ambient HOA coefficients 47' and the elements of the interpolated foreground V[k] vectors $\mathbf{55}_k$".

The foreground formulation unit 78 may represent a unit configured to perform matrix multiplication with respect to the adjusted foreground V[k] vectors $\mathbf{55}_k$'" and the interpolated nFG signals 49' to generate the foreground HOA coefficients 65. In this respect, the foreground formulation unit 78 may combine the audio objects 49' (which is another way by which to denote the interpolated nFG signals 49') with the vectors $\mathbf{55}_k$'" to reconstruct the foreground or, in other words, predominant aspects of the HOA coefficients 11'. The foreground formulation unit 78 may perform a matrix multiplication of the interpolated nFG signals 49' by the adjusted foreground V[k] vectors $\mathbf{55}_k$'".

The HOA coefficient formulation unit 82 may represent a unit configured to combine the foreground HOA coefficients 65 to the adjusted ambient HOA coefficients 47" so as to obtain the HOA coefficients 11'. The prime notation reflects that the HOA coefficients 11' may be similar to but not the same as the HOA coefficients 11. The differences between the HOA coefficients 11 and 11' may result from loss due to transmission over a lossy transmission medium, quantization or other lossy operations.

FIG. 5B is a block diagram illustrating another example of the spatial audio decoding device 410 that may perform the normalization techniques described in this disclosure. The example of the spatial audio decoding device 410 shown in the example of FIG. 5B is shown as spatial audio decoding device 410B. The spatial audio decoding device 410B of FIG. 5B may be substantially the same as that shown in the example of FIG. 5A, except that the spatial audio decoding device 410B of FIG. 5B includes a modified version of the vector-based reconstruction unit 92 denoted as vector-based reconstruction unit 90. The vector-based reconstruction unit 90 is similar to the vector-based reconstruction unit 92 except for being modified to remove the inverse gain control unit 86. In other words, the vector-based reconstruction unit 90 does not include an inverse gain control unit or otherwise perform automatic or other forms of inverse gain control with respect to the normalized ambient HOA coefficients 47" or the interpolated nFG signals 49'.

Figure 6A:
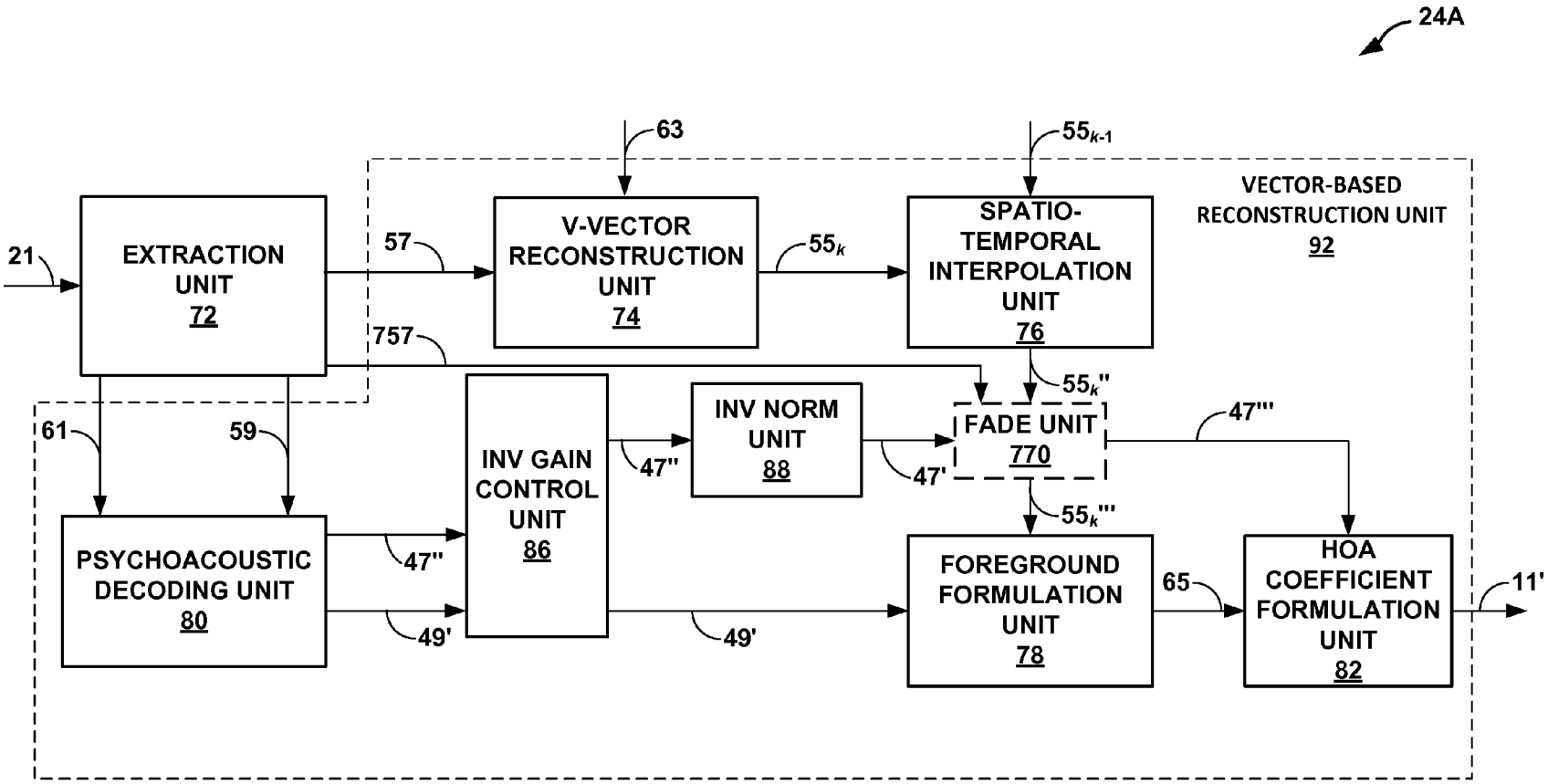
FIGS. 6A and 6B are block diagrams each illustrating, in more detail, different examples of the audio decoding device 24 shown in the examples of FIGS. 2 and 3
Figure 6B:
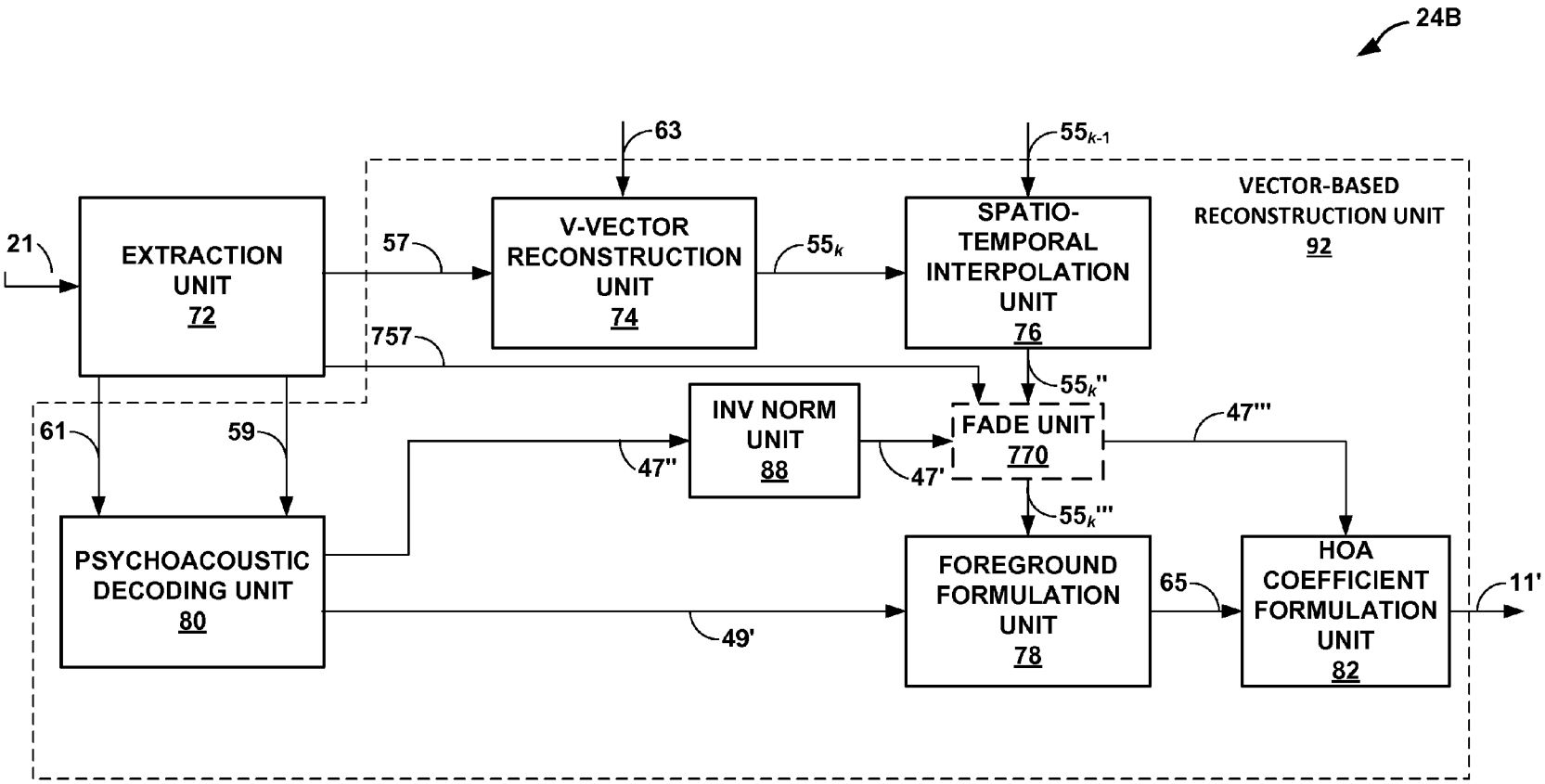

FIGS. 6A and 6B are block diagrams each illustrating different examples of the audio decoding device 24 shown in the examples of FIGS. 2 and 3 that are configured to perform various aspects of the normalization techniques described in this disclosure. Referring first to FIG. 6A, the example of the audio decoding device 24 is denoted as audio decoding device 24A. The audio decoding device 24A may be substantially similar to the spatial audio decoding device 410A shown in FIG. 5A, except that the extraction unit 72 is configured to extract encoded ambient HOA coefficients 59 and encoded nFG signals 61. Another difference between the spatial audio decoding device 410A and the audio decoding device 24A is that the vector-based reconstruction unit 92 of the audio decoding device 24A includes a psychoacoustic decoding unit 80. The extraction unit 72 may provide the encoded ambient HOA coefficients 59 and the encoded nFG signals 61 to the psychoacoustic decoding unit 80. The psychoacoustic decoding unit 80 may perform psychoacoustic audio decoding with respect to the encoded ambient HOA coefficients 59 and the encoded nFG signals 61 and output the normalized ambient HOA coefficients 47" and the interpolated nFG signals 49' to the inverse gain control unit 86.

FIG. 6B is a block diagram illustrating another example of the audio decoding device 24 that may perform the normalization techniques described in this disclosure. The audio decoding device 24B of FIG. 6B may represent another example of the audio decoding device 24 of FIGS. 2 and 3. The audio decoding device 24B may be substantially the same as that shown in the example of FIG. 6A, except that the audio decoding device 24B of FIG. 6B includes a modified version of the vector-based reconstruction unit 92 denoted as vector-based reconstruction unit 90. The vector-based reconstruction unit 90 is similar to the vector-based reconstruction unit 92 except for being modified to remove the inverse gain control unit 86. In other words, the vector-based reconstruction unit 90 does not include an inverse gain control unit or otherwise perform automatic or other forms of inverse gain control with respect to the normalized ambient HOA coefficients 47" or the interpolated nFG signals 49'.

Figure 7:
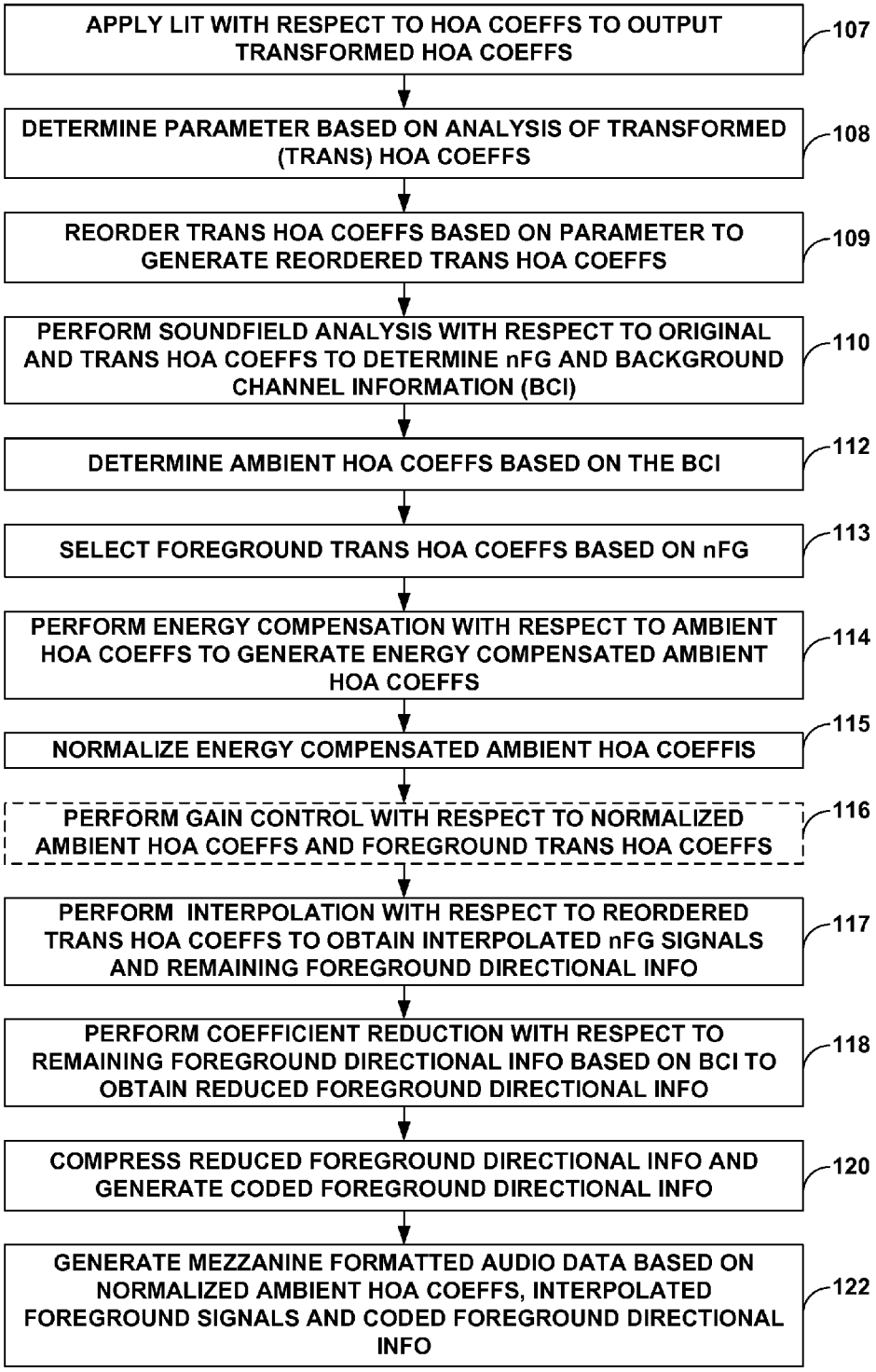
FIG. 7 is a flowchart illustrating exemplary operation of an audio encoding device in performing various aspects of the vector-based synthesis techniques described in this disclosure.

FIG. 7 is a flowchart illustrating exemplary operation of an audio encoding device, such as the spatial audio encoding device 20 shown in the example of FIGS. 2 and 3, in performing various aspects of the vector-based synthesis techniques described in this disclosure. Initially, the spatial audio encoding device 20 receives the HOA coefficients 11. The spatial audio encoding device 20 may invoke the LIT unit 30, which may apply a LIT with respect to the HOA coefficients to output transformed HOA coefficients (e.g., in the case of SVD, the transformed HOA coefficients may comprise the US[k] vectors 33 and the V[k] vectors 35) (107).

The spatial audio encoding device 20 may next invoke the parameter calculation unit 32 to perform the above described analysis with respect to any combination of the US[k] vectors 33, US[k−1] vectors 33, the V[k] and/or V[k−1] vectors 35 to identify various parameters in the manner described above. That is, the parameter calculation unit 32 may determine at least one parameter based on an analysis of the transformed HOA coefficients 33/35 (108).

The spatial audio encoding device 20 may then invoke the reorder unit 34, which may reorder the transformed HOA coefficients (which, again in the context of SVD, may refer to the US[k] vectors 33 and the V[k] vectors 35) based on the parameter to generate reordered transformed HOA coefficients 33'/35' (or, in other words, the US[k] vectors 33' and the V[k] vectors 35'), as described above (109). The spatial audio encoding device 20 may, during any of the foregoing operations or subsequent operations, also invoke the soundfield analysis unit 44. The soundfield analysis unit 44 may, as described above, perform a soundfield analysis with respect to the HOA coefficients 11 and/or the transformed HOA coefficients 33/35 to determine the total number of foreground channels (nFG) 45, the order of the background soundfield ($N_{BG}$) and the number (nBGa) and indices (i) of additional BG HOA channels to send (which may collectively be denoted as background channel information 43 in the example of FIG. 4) (110).

The spatial audio encoding device 20 may also invoke the background selection unit 48. The background selection unit 48 may determine background or ambient HOA coefficients 47 based on the background channel information (BCI) 43 (112). The spatial audio encoding device 20 may further invoke the foreground selection unit 36, which may select those of the reordered US[k] vectors 33' and the reordered V[k] vectors 35' that represent foreground or distinct components of the soundfield based on nFG 45 (which may represent a one or more indices identifying these foreground vectors) (113).

The spatial audio encoding device 20 may invoke the energy compensation unit 38. The energy compensation unit 38 may perform energy compensation with respect to the ambient HOA coefficients 47 to compensate for energy loss due to removal of various ones of the HOA channels by the background selection unit 48 (114) and thereby generate energy compensated ambient HOA coefficients 47'. The normalization unit 60 may normalize the energy compensated ambient HOA coefficients 47' to generate normalized ambient HOA coefficients 47" (115). In some examples, such as the example shown in FIG. 4A, the gain control unit 62 may perform gain control with respect to the normalized ambient HOA coefficients 47" and the interpolated nFG audio signals 49' (116). However, in other examples, such as the example shown in FIG. 4B, gain control may not be applied. The variation in application of gain control is denoted by using a dashed line for step 116.

The spatial audio encoding device 20 may also invoke the spatio-temporal interpolation unit 50. The spatio-temporal interpolation unit 50 may perform spatio-temporal interpolation with respect to the reordered transformed HOA coefficients 33'/35' to obtain the interpolated foreground signals 49' (which may also be referred to as the "interpolated nFG signals 49'") and the remaining foreground directional information 53 (which may also be referred to as the "V[k] vectors 53") (116). The spatial audio encoding device 20 may then invoke the coefficient reduction unit 46. The coefficient reduction unit 46 may perform coefficient reduction with respect to the remaining foreground V[k] vectors 53 based on the background channel information 43 to obtain reduced foreground directional information 55 (which may also be referred to as the reduced foreground V[k] vectors 55) (118).

The spatial audio encoding device 20 may invoke the quantization unit 52 to compress, in the manner described above, the reduced foreground V[k] vectors 55 and generate coded foreground V[k] vectors 57 (120).

The spatial audio encoding device 20 may invoke the mezzanine format unit 40. The mezzanine format unit 40 may generate the mezzanine formatted audio data 15 based on the coded foreground V[k] vectors 57, normalized ambient HOA coefficients 47", the interpolated nFG signals 49' and the background channel information 43 (122).

Figure 8:
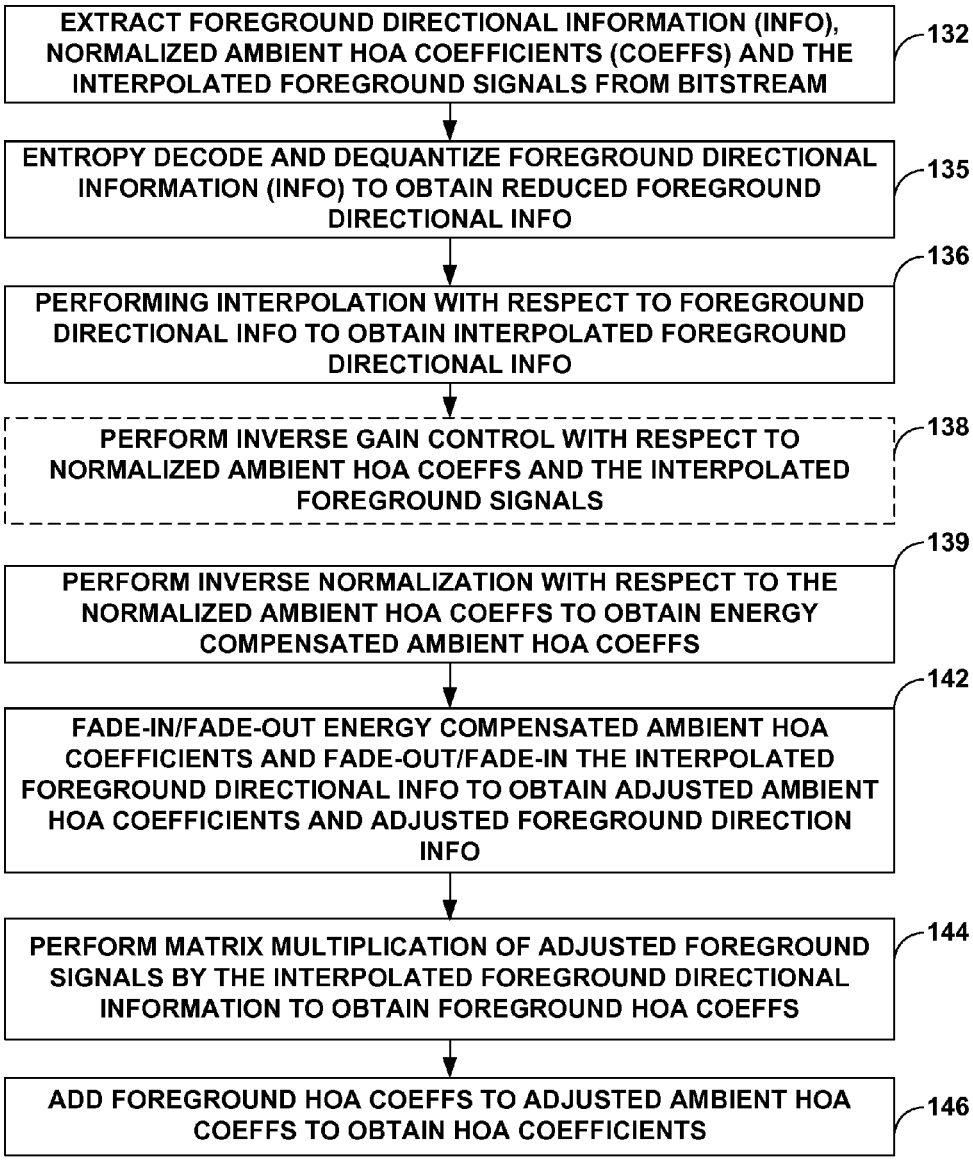
FIG. 8 is a flow chart illustrating exemplary operation of an audio decoding device in performing various aspects of the techniques described in this disclosure.

FIG. 8 is a flow chart illustrating exemplary operation of an audio decoding device, such as the spatial audio decoding device 410 shown in FIGS. 2 and 3, in performing various aspects of the techniques described in this disclosure. Initially, the spatial audio decoding device 410 may receive the bitstream 21. Upon receiving the bitstream, the spatial audio decoding device 410 may invoke the extraction unit 72. The extraction device 72 may parse this bitstream to retrieve the above noted information, passing this information to the vector-based reconstruction unit 92.

In other words, the extraction unit 72 may extract the foreground directional information 57 (which, again, may also be referred to as the coded foreground V[k] vectors 57), the normalized ambient HOA coefficients 47" and the interpolated foreground signals (which may also be referred to as the interpolated foreground nFG signals 49' or the interpolated foreground audio objects 49') from the bitstream 21 in the manner described above (132).

The spatial audio decoding device 410 may further invoke the quantization unit 74. The quantization unit 74 may entropy decode and dequantize the coded foreground directional information 57 to obtain reduced foreground directional information $\mathbf{55}_k$ (135).

The spatial audio decoding device 410 may next invoke the spatio-temporal interpolation unit 76. The spatio-temporal interpolation unit 76 may receive the reordered foreground directional information $\mathbf{55}_k'$ and perform the spatio-temporal interpolation with respect to the reduced foreground directional information $\mathbf{55}_k/\mathbf{55}_{k-1}$ to generate the interpolated foreground directional information $\mathbf{55}_k''$ (136). The spatio-temporal interpolation unit 76 may forward the interpolated foreground V[k] vectors $\mathbf{55}_k''$ to the fade unit 770.

The spatial audio decoding device 410 may invoke the inverse gain control unit 86. The inverse gain control unit 86 may perform inverse gain control with respect to normalized ambient HOA coefficients 47" and the interpolated foreground signals 49' as described above with respect to the example of FIG. 5A (138). In other examples, such as the example shown in FIG. 5B, the spatial audio decoding device 410 may not apply inverse gain control. To denote these different examples where inverse gain control may or may not be applied, step 138 is shown as having dashed lines.

The spatial audio decoding device 410 may also invoke inverse normalization unit 88. Inverse normalization unit 88 may perform inverse normalization with respect to the normalized ambient HOA coefficients 47" to obtain energy compensated HOA coefficients 47' (139). The inverse normalization unit 88 may provide the energy compensated HOA coefficients 47' to the fade unit 770.

The audio decoding device 24 may invoke the fade unit 770. The fade unit 770 may receive or otherwise obtain syntax elements (e.g., from the extraction unit 72) indicative of when the energy compensated ambient HOA coefficients 47' are in transition (e.g., the AmbCoeffTransition syntax element). The fade unit 770 may, based on the transition syntax elements and the maintained transition state information, fade-in or fade-out the energy compensated ambient HOA coefficients 47' outputting adjusted ambient HOA coefficients 47" to the HOA coefficient formulation unit 82. The fade unit 770 may also, based on the syntax elements and the maintained transition state information, and fade-out or fade-in the corresponding one or more elements of the interpolated foreground V[k] vectors $\mathbf{55}_k$" outputting the adjusted foreground V[k] vectors $\mathbf{55}_k$'" to the foreground formulation unit 78 (142).

The audio decoding device 24 may invoke the foreground formulation unit 78. The foreground formulation unit 78 may perform matrix multiplication the nFG signals 49' by the adjusted foreground directional information $\mathbf{55}_k$'" to obtain the foreground HOA coefficients 65 (144). The audio decoding device 24 may also invoke the HOA coefficient formulation unit 82. The HOA coefficient formulation unit 82 may add the foreground HOA coefficients 65 to adjusted ambient HOA coefficients 47" so as to obtain the HOA coefficients 11' (146).

Although described in the context of a broadcast setting, the techniques may be performed with respect to any content creator. Moreover, although described with respect to a mezzanine formatted bitstream, the techniques may be applied to any type of bitstream, including a bitstream that conforms to a standard, such as the phase I or phase II of the MPEG-H 3D audio coding standard referenced above. A more general content creator context is described below with respect to the example of FIG. 10.

Figure 9:
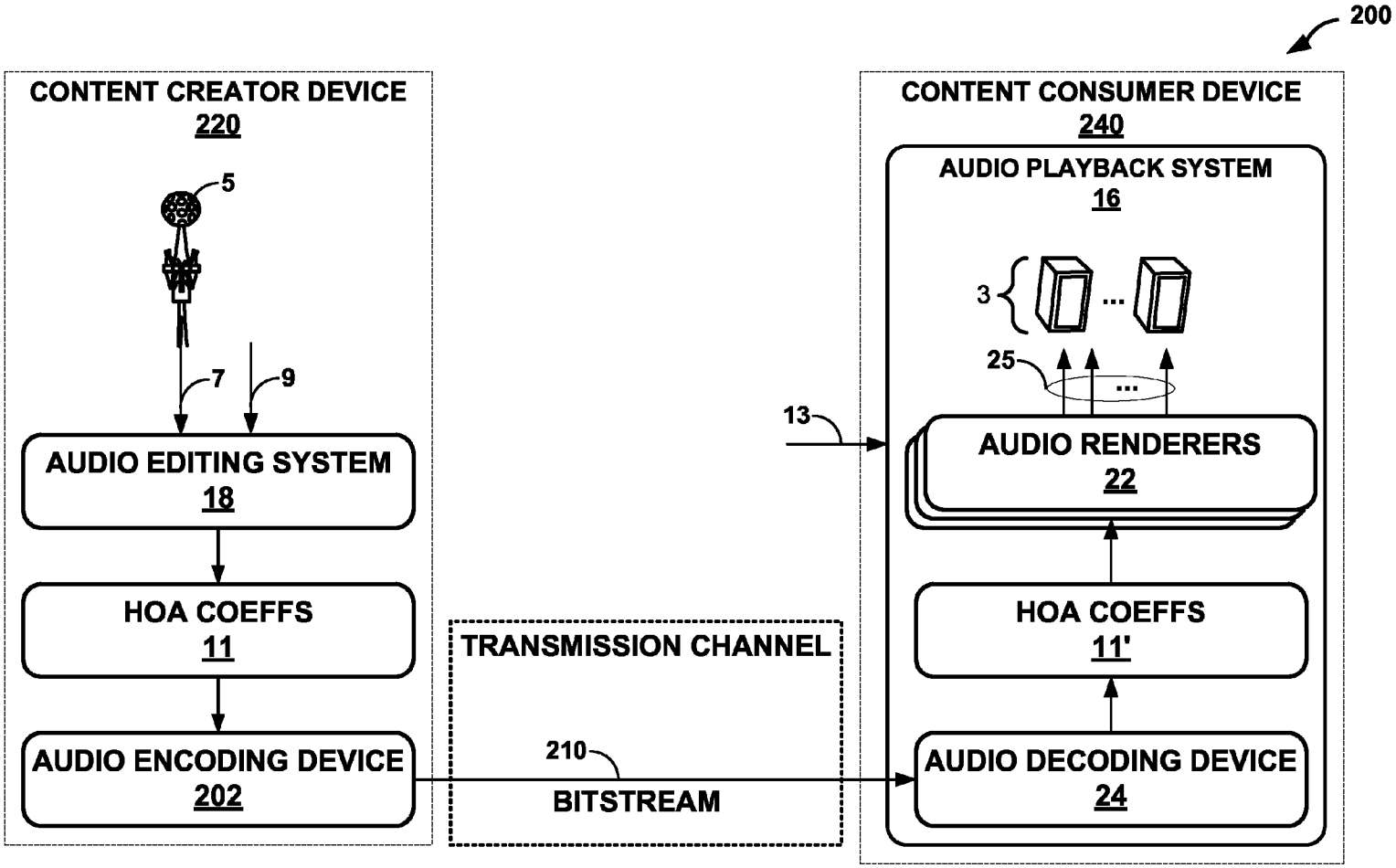
FIG. 9 is a diagram illustrating another system that may perform various aspects of the techniques described in this disclosure.

FIG. 9 is a diagram illustrating a system 200 that may perform various aspects of the techniques described in this disclosure. As shown in the example of FIG. 10, the system 200 includes a content creator device 220 and a content consumer device 240. While described in the context of the content creator device 220 and the content consumer device 240, the techniques may be implemented in any context in which SHCs (which may also be referred to as HOA coefficients) or any other hierarchical representation of a soundfield are encoded to form a bitstream representative of the audio data.

Moreover, the content creator device 220 may represent any form of computing device capable of implementing the techniques described in this disclosure, including a handset (or cellular phone), a tablet computer, a smart phone, or a desktop computer to provide a few examples. Likewise, the content consumer device 240 may represent any form of computing device capable of implementing the techniques described in this disclosure, including a handset (or cellular phone), a tablet computer, a smart phone, a set-top box, or a desktop computer to provide a few examples.

The content creator device 220 may be operated by a movie studio or other entity that may generate multi-channel audio content for consumption by operators of content consumer devices, such as the content consumer device 240. In some examples, the content creator device 220 may be operated by an individual user who would like to compress HOA coefficients 11. The content creator may generate audio content in conjunction with video content. The content consumer device 240 may be operated by an individual. The content consumer device 240 may include an audio playback system 16, which may refer to any form of audio playback system capable of rendering SHC for play back as multi-channel audio content. The audio playback system 16 may be the same as the audio playback system 16 shown in the examples of FIGS. 2 and 3.

The content creator device 220 includes an audio editing system 18. The content creator device 220 may obtain live recordings 7 in various formats (including directly as HOA coefficients) and audio objects 9, which the content creator device 220 may edit using audio editing system 18. A microphone 5 may capture the live recordings 7. The content creator may, during the editing process, render HOA coefficients 11 from audio objects 9, listening to the rendered speaker feeds in an attempt to identify various aspects of the soundfield that require further editing. The content creator device 220 may then edit HOA coefficients 11 (potentially indirectly through manipulation of different ones of the audio objects 9 from which the source HOA coefficients may be derived in the manner described above). The content creator device 220 may employ the audio editing system 18 to generate the HOA coefficients 11. The audio editing system 18 represents any system capable of editing audio data and outputting the audio data as one or more source spherical harmonic coefficients.

When the editing process is complete, the content creator device 220 may generate a bitstream 21 based on the HOA coefficients 11. That is, the content creator device 220 includes an audio encoding device 202 that represents a device configured to encode or otherwise compress HOA coefficients 11 in accordance with various aspects of the techniques described in this disclosure to generate the bitstream 21. The audio encoding device 202 may be similar to the spatial audio encoding device 20, except that the audio encoding device 202 includes a psychoacoustic audio encoding unit (similar to psychoacoustic audio encoding unit 406) that performs psychoacoustic audio encoding with respect to the normalized nFG signals 47" and the interpolated nFG signals 49' prior to a bitstream generation unit (which may be similar to mezzanine format unit 40) forming the bitstream 21.

The audio encoding device 20 may generate the bitstream 21 for transmission, as one example, across a transmission channel, which may be a wired or wireless channel, a data storage device, or the like. The bitstream 21 may represent an encoded version of the HOA coefficients 11 and may include a primary bitstream and another side bitstream, which may be referred to as side channel information.

While shown in FIG. 10 as being directly transmitted to the content consumer device 240, the content creator device 220 may output the bitstream 21 to an intermediate device positioned between the content creator device 220 and the content consumer device 240. The intermediate device may store the bitstream 21 for later delivery to the content consumer device 240, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the content creator device 220 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In any event, the techniques of this disclosure should not therefore be limited in this respect to the example of FIG. 10.

As further shown in the example of FIG. 10, the content consumer device 240 includes the audio playback system 16. The audio playback system 16 may represent any audio playback system capable of playing back multi-channel audio data. The audio playback system 16 may include a number of different renderers 22. The renderers 22 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 24, which may be similar to or the same as the audio decoding device 24 shown in FIGS. 2 and 3. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel. The audio playback system 16 may, after decoding the bitstream 21 to obtain the HOA coefficients 11' and render the HOA coefficients 11' to output loudspeaker feeds 25. The loudspeaker feeds 25 may drive one or more loudspeakers 3.

To select the appropriate renderer or, in some instances, generate an appropriate renderer, the audio playback system 16 may obtain loudspeaker information 13 indicative of a number of loudspeakers and/or a spatial geometry of the loudspeakers. In some instances, the audio playback system 16 may obtain the loudspeaker information 13 using a reference microphone and driving the loudspeakers in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may then select one of the audio renderers 22 based on the loudspeaker information 13. In some instances, the audio playback system 16 may, when none of the audio renderers 22 are within some threshold similarity measure (in terms of the loudspeaker geometry) to the loudspeaker geometry specified in the loudspeaker information 13, generate the one of audio renderers 22 based on the loudspeaker information 13. The audio playback system 16 may, in some instances, generate one of the audio renderers 22 based on the loudspeaker information 13 without first attempting to select an existing one of the audio renderers 22. One or more speakers 3 may then playback the rendered loudspeaker feeds 25.

In addition, the foregoing techniques may be performed with respect to any number of different contexts and audio ecosystems and should not be limited to any of the contexts or audio ecosystems described above. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as the spatial audio encoding device 20 of FIGS. 4A and 4B.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as the spatial audio encoding device 20 of FIGS. 4A and 4B.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Moreover, as used herein, "A and/or B" means "A or B", or both "A and B."

Various aspects of the techniques have been described. These and other aspects of the techniques are within the scope of the following claims.

The invention claimed is:

1. A device configured to decode higher order ambisonic audio data, the device comprising:

a memory configured to store an audio channel that provides a normalized ambient higher order ambisonic coefficient representative of at least a portion of an ambient component of a soundfield; and one or more processors coupled to the memory, and configured to:

determine that the audio channel is transitioning from providing a predominant audio object that describes a predominant component of the soundfield to providing the normalized ambient higher order ambisonic coefficient; and perform inverse normalization with respect to the audio channel responsive to determining that the audio channel provides the normalized ambient higher order ambisonic coefficient.

2. The device of claim 1, wherein the one or more processors are configured to perform inverse three-dimensional normalization with respect to the audio channel that provides the normalized ambient higher order ambisonic coefficient.

3. The device of claim 1, wherein the one or more processors are configured to perform inverse semi-three-dimensional normalization with respect to the audio channel that provides the normalized ambient higher order ambisonic coefficient.

4. The device of claim 1, wherein the normalized ambient higher order ambisonic coefficient is associated with a spherical basis function having an order greater than zero.

5. The device of claim 1, wherein the normalized ambient higher order ambisonic coefficient includes a normalized ambient higher order ambisonic coefficient that is specified in addition to a plurality of ambient higher order ambisonic coefficients specified in a plurality of different audio channels and that is used to augment the plurality of ambient higher order ambisonic coefficients in representing the ambient component of the sound field.

6. The device of claim 1, wherein the one or more processors are configured to apply an inverse normalization factor to the normalized ambient higher order ambisonic coefficient.

7. The device of claim 1, wherein the one or more processors are configured to determine an inverse normalization factor as a function of at least one order of a spherical basis function to which the normalized ambient higher order ambisonic coefficient is associated, and apply the inverse normalization factor to the normalized ambient higher order ambisonic coefficient.

8. The device of claim 1, wherein the normalized ambient higher order ambisonic coefficient is identified through a linear decomposition of a plurality higher order ambisonic coefficients representative of the soundfield.

9. The device of claim 1, wherein the normalized ambient higher order ambisonic coefficient conforms to an intermediate compression format.

10. The device of claim 9, wherein the intermediate compression format comprises a mezzanine compression format used by broadcast networks.

11. A method of decoding higher order ambisonic audio data, the method comprising:

determining that an audio channel is transitioning from providing a predominant audio object that describes a predominant component of a soundfield to providing a normalized ambient higher order ambisonic coefficient; and performing inverse normalization with respect to the audio channel when determining that the audio channel provides the normalized ambient higher order ambisonic coefficient, the ambient higher order ambisonic audio coefficient representative of at least a portion of an ambient component of the soundfield.

12. The method of claim 11, wherein performing the inverse normalization comprises performing the inverse normalization with respect to the normalized ambient higher order ambisonic coefficient after applying inverse gain control to the audio channel.

13. The method of claim 11, wherein performing the inverse normalization comprises performing the inverse normalization with respect to the normalized ambient higher order ambisonic coefficient so as to reduce application of inverse gain control to the audio channel.

14. The method of claim 11, wherein performing the inverse normalization comprises performing the inverse normalization with respect to the normalized ambient higher order ambisonic coefficient so as to avoid application of inverse gain control to the audio channel.

15. The method of claim 11, wherein performing the inverse normalization comprises performing the inverse normalization with respect to the normalized ambient higher order ambisonic coefficient instead of applying inverse gain control to the audio channel.

16. The method of claim 11, wherein determining that the audio channel is transitioning from the predominant audio object to providing the normalized ambient higher order ambisonic coefficient comprises obtaining a syntax element indicating that the audio channel is transitioning from providing a predominant audio object that describes a predominant component of the soundfield to providing the normalized ambient higher order ambisonic coefficient.

17. A device configured to encode higher order ambisonic audio data, the device comprising:

a memory configured to store a predominant audio object and an ambient higher order ambisonic coefficient representative of at least a portion of an ambient component of a soundfield; and one or more processors coupled to the memory, and configured to:

transition an audio channel from providing the predominant audio object to providing the ambient higher order ambisonic coefficient; and perform normalization with respect to the audio channel responsive to the audio channel providing the ambient higher order ambisonic coefficient.

18. The device of claim 17, wherein the one or more processors are configured to perform three-dimensional normalization with respect to the audio channel that provides the ambient higher order ambisonic coefficient.

19. The device of claim 17, wherein the one or more processors are configured to perform semi-three-dimensional normalization with respect to the audio channel that provides the ambient higher order ambisonic coefficient.

20. The device of claim 17, wherein the ambient higher order ambisonic coefficient is associated with a spherical basis function having an order greater than zero.

21. The device of claim 17, wherein the one or more processors are configured to determine a normalization factor as a function of at least one order of a spherical basis function to which the ambient higher order ambisonic coefficient is associated, and apply the normalization factor to the ambient higher order ambisonic coefficient.

22. The device of claim 17, further comprising generating a bitstream that includes the normalized ambient higher order ambisonic coefficient such that the bitstream conforms to an intermediate compression format.

23. The device of claim 22, wherein the intermediate compression format comprises a mezzanine compression format used in broadcast networks.

24. A method of encoding higher order ambisonic audio data comprising:

transitioning an audio channel from providing a predominant audio object to providing an ambient higher order ambisonic coefficient; and performing normalization with respect to the audio channel when the audio channel provides the ambient higher order ambisonic coefficient, the ambient higher order ambisonic audio coefficient representative of at least a portion of an ambient component of a soundfield.

25. The method of claim 24, wherein performing the normalization comprises performing the normalization with respect to the ambient higher order ambisonic coefficient prior to applying gain control to the audio channel.

26. The method of claim 24, wherein performing the normalization comprises performing the normalization with respect to the ambient higher order ambisonic coefficient so as to reduce application of gain control to the audio channel.

27. The method of claim 24, wherein performing the normalization comprises performing the normalization with respect to the ambient higher order ambisonic coefficient instead of applying gain control to the audio channel.

28. The device of claim 1, further comprising one or more loudspeakers coupled to the one or more processors, wherein the one or more processors are further configured to:

render, based on the audio channel, one or more loudspeaker feeds; and output the one or more loudspeaker feeds to the one or more loudspeakers.

29. The method of claim 11, further comprising:

rendering, based on the audio channel, one or more loudspeaker feeds; and outputting the one or more loudspeaker feeds to one or more loudspeakers.

30. The device of claim 17, further comprising a microphone coupled to the one or more processors, and configured to capture audio data representative of the ambient higher order ambisonic coefficient.

31. The method of claim 24, further comprising capturing, by a microphone, audio data representative of the ambient higher order ambisonic coefficient.

* * * * *